US009046863B2

(12) United States Patent
Kami et al.

(10) Patent No.: US 9,046,863 B2
(45) Date of Patent: Jun. 2, 2015

(54) IMAGE FORMING APPARATUS, AND IMAGE FORMING METHOD

(71) Applicants: Hidetoshi Kami, Shizuoka (JP); Kazuyuki Nakatsuru, Tokyo (JP)

(72) Inventors: Hidetoshi Kami, Shizuoka (JP); Kazuyuki Nakatsuru, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/105,534

(22) Filed: Dec. 13, 2013

(65) Prior Publication Data

US 2014/0193185 A1 Jul. 10, 2014

(30) Foreign Application Priority Data

Jan. 9, 2013 (JP) ..... 2013-001521

(51) Int. Cl.
*G03G 21/00* (2006.01)
*G03G 5/00* (2006.01)

(52) U.S. Cl.
CPC ..... *G03G 21/0011* (2013.01); *G03G 5/005* (2013.01); *G03G 21/0035* (2013.01)

(58) Field of Classification Search
CPC ..... G03G 5/005; G03G 21/0011; G03G 21/0035; G03G 21/0094
USPC ..... 399/159, 346, 350
See application file for complete search history.

(56) References Cited

U.S. PATENT DOCUMENTS

| | | | |
|---|---|---|---|
| 2010/0189461 | A1 | 7/2010 | Shintani et al. |
| 2010/0316423 | A1 | 12/2010 | Kami et al. |
| 2011/0200924 | A1 | 8/2011 | Kami et al. |

FOREIGN PATENT DOCUMENTS

| | | | |
|---|---|---|---|
| EP | 2 341 402 | A1 | 7/2011 |
| JP | 62108276 | A * | 5/1987 |
| JP | 2000-066424 | | 3/2000 |
| JP | 2000-171990 | | 6/2000 |
| JP | 2006-091047 | | 4/2006 |
| JP | 2007-108300 | | 4/2007 |
| JP | 2008-122870 | | 5/2008 |
| JP | 2009-003320 | | 1/2009 |
| JP | 2010-169899 | | 8/2010 |

OTHER PUBLICATIONS

The Extended European Search Report issued May 19, 2014, in Application No. 13197266.3—1303.

* cited by examiner

*Primary Examiner* — Ryan Walsh

(74) *Attorney, Agent, or Firm* — Oblon, McClelland, Maier & Neustadt, L.L.P.

(57) ABSTRACT

An image forming apparatus is provided. The image forming apparatus includes a photoreceptor; a charger to charge a surface of the photoreceptor; a circulating agent applicator to apply a circulating agent to the surface of the photoreceptor while contacting the surface of the photoreceptor to form a film of the circulating agent on the surface of the photoreceptor; and a contact member contacted with the surface of the photoreceptor. The acting force, which is generated by contact of the contact member with the photoreceptor and includes a tangential force Ft, which is a force in a tangential direction at a contact portion of the contact member with the surface of the photoreceptor, and a normal force Fn, which is a force in a normal direction at the contact portion, satisfies the following relationships, $0.90 \leq Ft/Fn \leq 0.96$, and $1.15\ kgf \leq Ft \leq 1.35\ kgf$.

11 Claims, 15 Drawing Sheets

IMAGE FORMING APPARATUS, AND IMAGE FORMING METHOD

CROSS-REFERENCE TO RELATED APPLICATIONS

This patent application is based on and claims priority pursuant to 35 U.S.C. §119 to Japanese Patent Application No. 2013-001521 filed on Jan. 9, 2013 in the Japan Patent Office, the entire disclosure of which is hereby incorporated by reference herein.

TECHNICAL FIELD

This disclosure relates to an image forming apparatus and an image forming method.

BACKGROUND

Photoreceptors using an inorganic photosensitive material such as selenium, zinc oxide, or cadmium sulfide were popularly used for copiers and laser printers, but now organic photoreceptors (OPC) using an organic photosensitive material are popularly used therefor because of having advantages over the inorganic photoreceptors such that environmental burdens can be reduced, costs are relatively low, and designing flexibility is relatively high. At the present time, the share of such organic photoreceptors in electrophotographic photoreceptor market is close to 100%. Since environmental preservation is promoted recently, it is desired that such electrophotographic photoreceptors are changed from a supply good (i.e., a disposable good) to a mechanical part (a good having high durability).

Various attempts to impart high durability to organic photoreceptors have been conventionally made. At the present time, a photoreceptor (disclosed, for example, by JP-2000-66424-A) in which a crosslinked resin layer is formed as an outermost layer thereof, and a photoreceptor (disclosed, for example, by JP-2000-171990-A) in which a sol-gel hardened layer is formed as an outermost layer thereof have a high degree of expectation. The former photoreceptor has an advantage such that even when a charge transport material is included in the outermost layer, problems such that the outermost layer is broken or cracked are hardly caused, and thereby the yield of the photoreceptor in the production process can be enhanced. Particularly, by using a radically polymerizable acrylic resin for the outermost layer, the resultant photoreceptor has a good combination of mechanical strength and photosensitivity. Since the crosslinked outermost layers of the above-mentioned two kinds of photoreceptors are formed by plural chemical bonds, a problem such that the outermost layer becomes abradable is not caused even when part of the chemical bonds is cut by a stress.

Recently, it is strengthened to control the amount of emission of carbon dioxide to protect the global environment, and therefore electrophotographic photoreceptors should be changed from a supply good to a mechanical part, and preferably to a reuse part. However, at the present time, electrophotographic photoreceptors have almost the same life as those of mechanical parts, but are not a reuse part having a longer life than the image forming apparatus for which the photoreceptors are used.

The durability of a photoreceptor is expected to be dramatically enhanced by forming a three-dimensional crosslinked structure on the surface of the photoreceptor.

In addition, coating a lubricant on a surface of a photoreceptor is performed for enhancing the cleaning property of toner (particularly, polymerized toner). The lubricant coating is also performed for protecting the photoreceptor from hazards from charging, and therefore contributes to prolongation of the life of the photoreceptor and the image forming apparatus.

However, even when these techniques are used in combination for a photoreceptor, the photoreceptor is used while sometimes replaced with a new photoreceptor at the present time. This is because the properties of the surface of a photoreceptor change after the photoreceptor is repeatedly used, thereby forming abnormal images and deteriorating the cleaning property of the photoreceptor.

Therefore, the life cycle of an image forming apparatus of from obtainment of raw materials of parts of the image forming apparatus, to disposal of the parts after repeated use, and recycling of some of the parts cannot be changed. Namely, a large amount of energy used for image formation using such an image forming apparatus and a large amount of carbon dioxide discharged from the image formation cannot be reduced.

Various technologies have been developed to improve the mechanical strength of photoreceptor, but improvement in the mechanical strength is saturated now.

SUMMARY

As an aspect of this disclosure, an image forming apparatus is provided which includes a photoreceptor, a charger to charge a surface of the photoreceptor, a circulating agent applicator to apply a circulating agent to the surface of the photoreceptor while contacting the surface of the photoreceptor to form a film of the circulating agent on the surface of the photoreceptor, and a contact member contacted with the surface of the photoreceptor. The acting force, which is generated by contact of the contact member with the surface of the photoreceptor and includes a tangential force Ft, which is a force in a tangential direction at a contact portion of the contact member with the surface of the photoreceptor, and a normal force Fn, which is a force in a normal direction at the contact portion, satisfies the following relationships:

$$0.90 \leq Ft/Fn \leq 0.96; \text{ and } 1.15 \text{ kgf}(11.27 \text{ N}) \leq Ft \leq 1.35 \text{ kgf}(13.23 \text{ N}).$$

As another aspect of this disclosure, an image forming method is provided which includes applying a circulating agent to a surface of a moving photoreceptor; forming a toner image on the surface of the moving photoreceptor; transferring the toner image onto a medium such as a recording medium or an intermediate transfer medium; and contacting a contact member with the surface of the moving photoreceptor. The acting force, which is generated by contact of the contact member with the photoreceptor and includes a tangential force Ft, which is a force in a tangential direction at a contact portion of the contact member with the surface of the photoreceptor, and a normal force Fn, which is a force in a normal direction at the contact portion, satisfies the following relationships:

$$0.90 \leq Ft/Fn \leq 0.96; \text{ and } 1.15 \text{ kgf}(11.27 \text{ N}) \leq Ft \leq 1.35 \text{ kgf}(13.23 \text{ N}).$$

The aforementioned and other aspects, features and advantages will become apparent upon consideration of the following description of the preferred embodiments taken in conjunction with the accompanying drawings.

DETAILED DESCRIPTION

Figure 1:
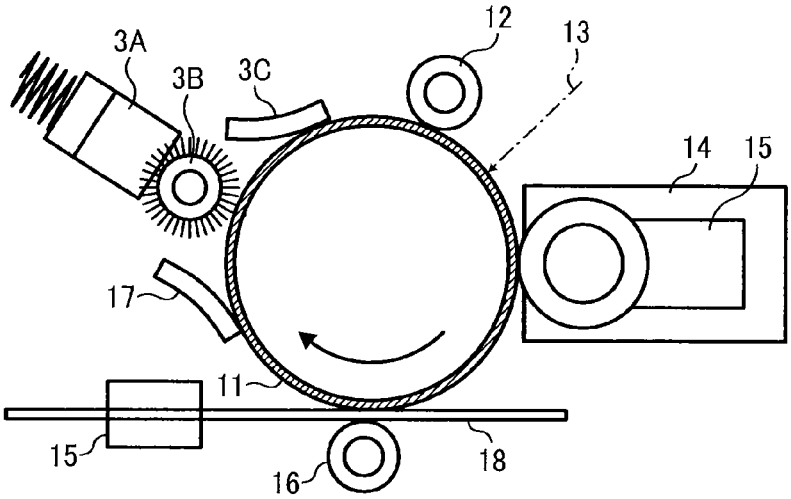
FIG. 1 is a schematic cross-sectional view illustrating an image forming apparatus according to an embodiment.

Although various technologies have been developed to improve the mechanical strength of photoreceptor, improvement in the mechanical strength is saturated now. The present inventors consider that technology of using a photoreceptor while stabilizing the properties of the surface of the photoreceptor is important. Although the technology of applying a lubricant to the surface of a photoreceptor is advantageous, control of input and output of a lubricant is insufficient, and therefore a problem in that the vicinity of the photoreceptor is contaminated is often caused, resulting in shortening of the life of the image forming apparatus.

The object of this disclosure is to provide an image forming apparatus which can produce prints at relatively low costs by using a photoreceptor having a relatively long life.

The image forming apparatus of this disclosure will be described. The image forming apparatus includes at least a photoreceptor, a charger to charge a surface of the photoreceptor, a circulating agent applicator to apply a circulating agent to the surface of the photoreceptor while contacting the surface of the photoreceptor, and a contact member contacted with the surface of the photoreceptor. The acting force, which is generated by contact of the contact member with the surface of the photoreceptor and includes a tangential force Ft, which is a force in a tangential direction at a contact portion of the contact member with the surface of the photoreceptor, and a normal force Fn, which is a force in a normal direction at the contact portion, satisfies the following relationships:

$$0.90 \leq Ft/Fn \leq 0.96; \text{ and } 1.15 \text{ kgf}(11.27 \text{ N}) \leq Ft \leq 1.35 \text{ kgf}(13.23 \text{ N}).$$

The image forming apparatus of this disclosure will be described in detail. The following embodiments are preferable embodiments, and therefore technically preferable limitations are attached thereto. However, the present disclosure is not limited thereto unless otherwise specified.

The image forming apparatus of this disclosure is characterized in that a circulating agent is applied to a base outermost layer of the photoreceptor of the image forming apparatus. In order to form a good film of the circulating agent on the base outermost layer, it is preferable that the surface of the base outermost layer is clean and the base outermost layer is prevented from degenerating. In order that the surface of the base outermost layer is clean, it is preferable to remove toner adhered to the surface to a maximum extent, and therefore it is preferable to arrange a circulating agent applicator on a downstream side from a cleaner, which cleans the surface of the photoreceptor, relative to the moving direction of the photoreceptor. In order to prevent the base outermost layer from degenerating, it is preferable to prevent change of the surface of the base outermost layer, which causes deterioration of conformability (fittability) of a member with the surface of the photoreceptor with which the member is contacted. Therefore, in order that the base outermost layer is not directly exposed to hazards from charging, the circulating agent applicator to apply a circulating agent to the surface of the base outermost layer is preferably arranged on an upstream side from a charger to charge the surface of the photoreceptor relative to the moving direction of the photoreceptor.

A film of a circulating agent is formed on the surface of the photoreceptor. When the area of defects in the film is less than 10% and in addition the mass thickness of the film is not less than one molecular layer of the circulating agent and less than three molecular layers, the film is referred to as "a circulating outermost layer." In this regard, the circulating agent means a material such that after a film of the agent is formed on the surface of a photoreceptor, the film is discharged from the surface of the photoreceptor, and the film formation and removal are repeated. The mass thickness can be determined by an ICP analysis (inductively coupled plasma spectroscopy) or an XRF analysis (X-ray fluorescence spectroscopy). The ICP analysis is performed by such a method as described in JP-2008-122870-A. When the XRF analysis is used, the thickness is determined using a working curve obtained from the ICP analysis. The mass thickness is calculated based on a method described in pp 154-161 of "Practice of Fluorescent X-ray Analysis" by Izumi Nakai, which was published in 2005 by Asakura Publishing Co., Ltd.

The area of defects in the circulating outermost layer formed on the base outermost layer is calculated by subtracting the coverage (%) of the base outermost layer with the circulating agent from 100(%). In this regard, the coverage can be determined by the XPS analysis described in JP-2008-122870-A. The mass thickness is a length determined by dividing the area density (in units of $g/cm^2$), which is described in "Practice of Fluorescent X-ray Analysis", by the density (in units of $g/cm^2$). In a case of zinc stearate, which is used for the below-mentioned examples, the thickness of one molecule thereof is 5 nm, and this thickness is used as a unit of the thickness of a layer in which two or more molecules of zinc stearate are overlaid. This thickness of zinc stearate is described in paragraph [0021] of JP-2006-91047-A.

The relationship between the amount of removed circulating agent and the amount of applied circulating agent is not applied only for a case where the circulating agent is applied to a new (unused) photoreceptor. This is because if the relationship such that the amount of applied circulating agent is not greater than the amount of removed circulating agent is satisfied in this case, the circulating agent is not applied to the new photoreceptor.

The circulating agent is applied to a photoreceptor having a non-steady state. Specifically, the circulating agent is initially applied to a new photoreceptor, which has produced 1,000 prints or less after being set to an image forming apparatus.

When a circulating agent is initially applied to a surface of a photoreceptor, it is possible to use a phenomenon such that the circulating agent is insufficiently applied to the surface of the photoreceptor, and the cleaner of the image forming apparatus insufficiently functions, resulting in accumulation of the circulating agent on the surface of the photoreceptor. Alternatively, the circulating agent may be applied using a setting powder.

The circulating outermost layer is defined as mentioned above. However, it is not easy to form a circulating outermost layer in an image forming apparatus or in an image forming process because the history of the property of the base outermost layer is always changed.

In the image forming process, not only a circulating agent is applied to the base outermost layer of the photoreceptor, but also a toner image is formed on the surface of the photoreceptor. When the circulating agent coating and the toner image formation are performed sequentially (at the same time), a film or a fish-form film including the toner components and paper dust is formed on the surface of the base outermost layer if the circulating agent coating is insufficiently performed. These films make it more impossible to apply the circulating agent to the surface of the photoreceptor as the image formation cycle is repeatedly performed. In addition, when the circulating agent has a poor film forming property and a film of the circulating agent cannot be well formed on the photoreceptor, the surface of the applied circulating agent layer becomes grainy. Further, when the circulating agent remains at the contact member contacted with the surface of the photoreceptor and then passes through the nip between the contact member and the surface of the photoreceptor, the circulating agent layer becomes a layer in which grains are dispersed.

When the circulating agent layer achieves such a state as mentioned above, the circulating agent layer contaminates or damages parts and devices in the vicinity of the photoreceptor such as a charger, an irradiator, a developing device, and a transferring device, resulting in shortening of the lives of the parts and devices. In addition, a problem such that the circulating agent is mixed with the developer (toner) in the developing device, thereby deteriorating the charge property of the toner is caused, resulting in deterioration of the durability of the image forming apparatus. It is not necessary for the circulating agent layer to include no grain. However, in order to prevent occurrence of the above-mentioned problems, the area of grains (grain portions) in the circulating agent layer of 2 mm square is preferably less than 0.05%, and more preferably less than 0.03%. The area ratio of grains can be determined by using image analyzing software such as ImageJ from National Institutes of Health and Image-Pro Plus from Media Cybernetics.

When a popular lubricant is applied to a surface of a photoreceptor in an image forming apparatus, the coverage of the surface with the lubricant is about 85%, and the lubricant layer is typically constituted of two to four molecular layers of the lubricant. In addition, the percentage of the area of grains in the circulating outermost layer is typically 0.1 to 2.5% although the percentage depends on the print patterns. Therefore, when the photoreceptor is repeatedly used, a problem such that abnormal images are formed by the photoreceptor, and therefore the photoreceptor has to be replaced with a new photoreceptor is caused. Namely, the lubricant layer formation is not formation of a circulating agent layer.

Conventionally, lubricant has been used for improving the sliding property of the surface of a photoreceptor, i.e., for decreasing the friction coefficient of the surface of a photoreceptor. In contrast, the circulating agent for use in the image forming apparatus of this disclosure is characterized by forming a film (like a peel or skin) to protect the surface of a photoreceptor, then removing the film from the surface of the photoreceptor, and repeating the film formation and removal. The film of the circulating agent has a proper coverage to protect the surface of the photoreceptor. Specifically, although the conventional coverage of the surface of a photoreceptor with a lubricant is about 85%, the coverage of the surface of a photoreceptor with the circulating agent in the image forming apparatus of this disclosure is not less than 90%. Thus, the coverage is largely different.

In addition, the image forming apparatus of this disclosure prevents occurrence of the filming problem and the part contamination problem mentioned above, and therefore has a remarkably long life.

Conventional lubricant applicators can be used for the circulating agent applicator for use in the image forming apparatus of this disclosure. Therefore, an increase in costs of the image forming apparatus can be prevented.

Since the image forming apparatus of this disclosure includes a circulating agent applicator to apply a circulating agent on a surface of a photoreceptor, the photoreceptor is not substantially abraded.

Conventionally, photoreceptor is used as a consumable good, and is frequently replaced with a new photoreceptor. However, in the image forming apparatus of this disclosure, it is not necessary to replace a photoreceptor with a new photoreceptor. Namely, it is not necessary to produce a new photoreceptor or to collect a used photoreceptor. Thus, the image forming apparatus can save materials and is environmental-friendly. Specifically, with respect to the costs of producing one print, the cost reduction effect of the image forming apparatus of this disclosure is much greater than that in conventional image forming apparatus in which the used photoreceptor is collected to be recycled.

In the image forming apparatus of this disclosure, a circulating agent is applied to the base outermost layer of the photoreceptor to form a circulating outermost layer on the base outermost layer. The image forming apparatus is characterized in that the amount of the circulating agent applied to the surface of the photoreceptor in a circulating agent application process is not greater than the amount of the circulating agent removed from the surface of the photoreceptor in a cleaning process performed before the next circulating agent application process. This is an important requirement for forming a circulating outermost layer on the outermost surface of the photoreceptor. By applying the circulating agent while controlling the application amount based on the amount of the removed circulating agent, the amount of the applied circulating agent and the amount of the removed circulating agent can be balanced so as to be equivalent (i.e., the mass balance of the circulating agent can be maintained).

In the image forming apparatus, it is ideal that the amount of the applied circulating agent is equal to the amount of the removed circulating agent. It is the next best that the amount of the applied circulating agent is slightly less than the amount of the removed circulating agent. It is not preferable that the amount of the applied circulating agent is much less than the amount of the removed circulating agent, because the number of defects formed in the circulating outermost layer increases. In addition, it is not preferable that the amount of the applied circulating agent is greater than the amount of the removed circulating agent, because the circulating agent remaining on the surface of the photoreceptor without being removed therefrom accumulates on the surface of the photoreceptor.

The circulating agent on the surface of the photoreceptor is generally decomposed when the photoreceptor is charged in a charging process. If the decomposition product of the circulating agent accumulates on a portion of the surface of the photoreceptor, the surface resistivity of the portion decreases and/or the friction coefficient of the portion changes, thereby forming defective images.

The circulating agent on the surface of the photoreceptor is mainly removed by the cleaner of the image forming apparatus, and is also removed by the developer and the intermediate transfer belt, which are contacted with the surface of the photoreceptor. Namely, the circulating agent removing process includes all the processes performed after the circulating agent application process and before the next circulating agent application process.

Even when the circulating agent on the surface of the photoreceptor is completely removed from the surface, the circulating agent is applied to the surface immediately. Therefore, it is impossible that the circulating agent is not present on the surface of the photoreceptor throughout a period of time between the circulating agent application process and the next circulating agent application process. Specifically, if 100% of the circulating agent on the surface of the photoreceptor is removed and then the circulating agent is applied thereto in an amount of 10%, the 10% circulating agent remains on the surface of the photoreceptor before the next removing (cleaning) process. Even if the 10% circulating agent is completely removed in the next removing process, the circulating agent is applied thereto in an amount of 10% in the next circulating agent application process. In the image forming apparatus, this application process and the removing process are repeatedly performed, it is impossible that the circulating agent is not present on the surface of the photoreceptor throughout a period of time between the circulating agent application process and the next circulating agent application process.

This technique seems to be similar to the conventional lubricant application technique. However, in the conventional lubricant application technique, a thick layer of a lubricant is formed on a surface of a photoreceptor to impart good lubricating property (good cleaning property) to the photoreceptor. Namely, the conventional lubricant application technique has no technological thought such that a circulating outermost layer is formed on a surface of a photoreceptor.

Specifically, in the conventional lubricant application technique, a lubricant is merely supplied to a surface of a photoreceptor from outside to protect the surface or to control the friction coefficient of the surface so as to be not greater than a predetermined value. When the surface of such a photoreceptor is visually observed, grains of the lubricant are present thereon. Such a granular lubricant contaminates parts and devices in the vicinity of the photoreceptor.

The amount of the circulating agent removed in the cleaning process can be calculated from the concentration of the circulating agent included in the collected toner. This analysis can be performed by the below-mentioned ICP (Inductively Coupled Plasma) analysis or XRF (X-ray Fluorescence) analysis. By preliminarily determining the total consumption of the circulating agent, the application amount of the circulating agent can be estimated, i.e., it becomes possible to balance the application amount and the removal amount.

Next, the method of controlling the amount of the applied circulating agent so as to be not greater than the amount of the removed circulating agent will be described. The amount of consumption of the circulating agent is the total of the amount of the circulating agent adhered to the surface of the photoreceptor, and the amount of losses of the circulating agent produced in image forming processes.

The losses of the circulating agent produced in image forming processes mean the amount of particles of the circulating agent, which are produced by scraping a circulating agent bar with a brush but which is scattered by the brush without applied to the surface of the photoreceptor. The amount of the losses can be determined by collecting and weighing the particles of the circulating agent present in the vicinity of the circulating agent applicator. In addition, the amount of the circulating agent removed from the surface of the photoreceptor can be determined by collecting and weighing the circulating agent present in the cleaner, a passage of from the cleaner to a waste toner tank, and the toner tank. When toner particles are included in the collected circulating agent, the weight of the collected circulating agent including the toner is measured and the concentration of the circulating agent therein is determined by an analysis to determine the weight of only the circulating agent.

If the total consumption of the circulating agent is greater than the total of the amount of the losses of the circulating agent and the amount of the removed circulating agent, it is assumed that part of the circulating agent is adhered to other parts such as chargers.

The efficiency of adhesion of the circulating agent to the surface of the photoreceptor changes depending on the conformability (fittability) of the part (such as application blade) applying the circulating agent with the surface of the photoreceptor. When an application blade is used to form a thin layer of the circulating agent, it is not preferable that the application blade contacting the surface of the photoreceptor perfectly blocks the circulating agent, and it is preferable to form a proper gap between the blade and the surface of the photoreceptor or to prevent vibration of the application blade.

In the image forming process, not only the circulating agent is applied to the base outermost layer of the photoreceptor, but also a toner image is formed on the surface of the photoreceptor. When the circulating agent application and the image formation are performed sequentially (at the same time), a film or a fish-form film including the toner components and paper dust is formed on the surface of the base outermost layer if the circulating agent coating is insufficiently performed. These films make it more impossible to apply the circulating agent to the surface of the photoreceptor as the image formation cycle is repeatedly performed. In addition, when the circulating agent has a poor film forming property and a film of the circulating agent cannot be well formed on the photoreceptor, the surface of the applied circulating agent layer becomes grainy. Further, when the circulating agent remains at the contact member contacted with the surface of the photoreceptor and then passes through the nip between the contact member and the surface of the photoreceptor, the circulating agent layer becomes a layer in which grains are dispersed.

When the circulating agent layer achieves such a state as mentioned above, the circulating agent layer contaminates or damages parts and devices in the vicinity of the photoreceptor such as a charger, an irradiator, a developing device, and a transferring device, resulting in shortening of the lives of the parts and devices. In addition, a problem such that the circulating agent is mixed with the developer (toner) in the developing device, thereby deteriorating the charge property of the toner is caused, resulting in deterioration of the durability of the image forming apparatus. It is not necessary for the circulating agent layer to include no grain. However, in order to prevent occurrence of the above-mentioned problems, the area of grains (grain portions) in the circulating agent layer of 2 mm square is preferably less than 0.05%, and more preferably less than 0.03%. The area ratio of grains can be determined by using image analyzing software such as ImageJ from National Institutes of Health and Image-Pro Plus from Media Cybernetics.

When a popular lubricant is applied to a surface of a photoreceptor in an image forming apparatus, the coverage of the surface with the lubricant is about 85%, and the lubricant layer is typically constituted of two to four molecular layers of the lubricant. In addition, the percentage of the area of grains in the circulating outermost layer is typically 0.1 to 2.5% although the percentage depends on the print patterns. Therefore, when the photoreceptor is repeatedly used, a problem such that abnormal images are formed by the photoreceptor, and therefore the photoreceptor has to be replaced with a new photoreceptor is caused. Namely, the lubricant layer formation is not formation of a circulating agent layer.

In contrast, in the image forming apparatus of this disclosure, shortening of life of the photoreceptor caused by the filming problem and the part contamination problem can be prevented, and the life of the photoreceptor can be dramatically extended.

Conventional lubricant applicators can be used for the circulating agent applicator for use in the image forming apparatus of this disclosure. Therefore, an increase in costs of the image forming apparatus can be prevented.

The image forming apparatus is characterized in that the amount of the circulating agent applied to the surface of the photoreceptor in a circulating agent application process is not greater than the amount of the circulating agent removed from the surface of the photoreceptor in a cleaning process performed before the next circulating agent application process. In addition, the percentage of area of defects in the circulating outermost layer is less than 10%, and the mass thickness of the circulating outermost layer corresponds to one to three molecules of the circulating agent. In order to form such a circulating outermost layer, it is important to thoroughly apply the circulating agent to the entire surface of the base outermost layer.

It is important to control input and output of the circulating agent for forming the circulating outermost layer. Particularly, the quality of the circulating outermost layer is strongly influenced by the property of the contact member to be contacted with the surface of the photoreceptor. The acting force of a contact member to clean the surface of the photoreceptor includes a compression stress generated by contacting the contact member with the surface of the photoreceptor, and a shearing force generated by rotation of the photoreceptor. In the present application, this acting force is measured by the following method.

Figure 25:
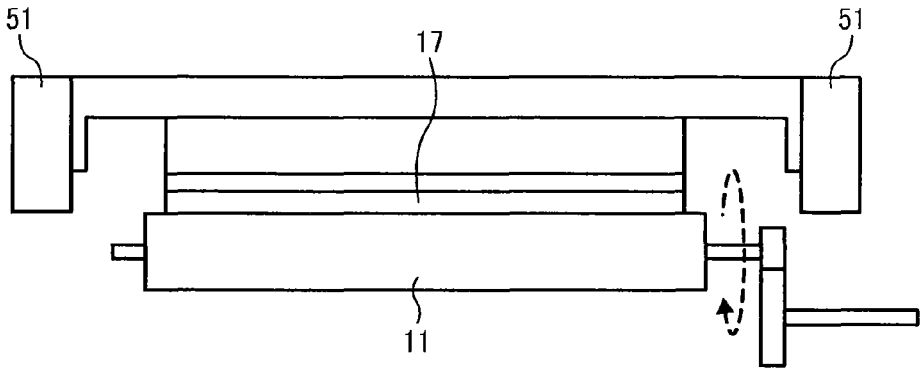
FIG. 25 is a schematic view illustrating an instrument used for measuring the acting force of a coating blade or a cleaning blade.

FIG. 25 illustrates an instrument used for measuring the acting force of a cleaning blade, which is used as the contact member.

Referring to FIG. 25, a plate on which a cleaning blade 17 is hung on two three-force-component meters 51 (i.e., dynamic strain measuring instrument) so that the cleaning blade is contacted with a surface of a photoreceptor 11. In this regard, the contact angle of the cleaning blade contacted with the surface of the photoreceptor and the digging amount of the cleaning blade digging into the surface of the photoreceptor are properly changed. In this regard, since the photoreceptor is hard, the blade does not dig into the surface of the photoreceptor in practice, the digging amount corresponds to the difference between the length of the blade and the gap between the holder of the blade to the surface of the photoreceptor. The photoreceptor 11 is connected with a driving source such as motors so as to be rotated at a proper speed. It is possible to set a torque meter to the driving source to measure the rotation force of the driving source.

The load data obtained by the three-force-component meters 51 are collected by a data logger. In this regard, the sum of the load data obtained by the two three-force-component meters 51 is the acting force.

Figure 26:
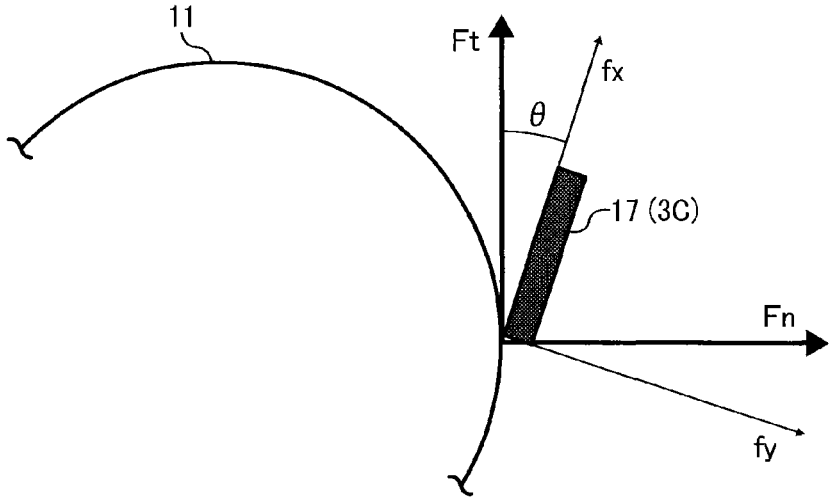
FIG. 26 is a schematic view for describing the tangential force and the normal force.

FIG. 26 is a schematic view for describing the tangential force and the normal force. Referring to FIG. 26, a load fx in a width direction (air surface direction) of the blade, and a load fy in a thickness direction (cut surface direction) of the blade can be determined by the three-force-component meters 51. When the contact angle of the cleaning blade to the surface of the photoreceptor is θ, the tangential force Ft and the normal force Fn of the cleaning blade 17 are calculated from the following equations (2) and (3):

$$Ft = fx \cdot \cos\theta - fy \cdot \sin\theta \quad (2), \text{ and}$$

$$Fn = fx \cdot \sin\theta - fy \cdot \cos\theta \quad (3).$$

The tangential force Ft represents a shearing force between the photoreceptor and the cleaning blade, and the normal force Fn represents a compression stress therebetween. The vector direction of the resultant stress is estimated from the following equation (4):

$$\arctan(Ft/Fn) \quad (4).$$

The same is true for the application blade 3C used for smoothing the coated circulating agent.

Hereinafter, the cleaning blade 17 and the application blade 3C are sometimes referred to as a blade.

A shearing force accompanied with a compression stress is generated in the blade contacted with the photoreceptor. The compression stress is a force in the normal direction of the surface of the photoreceptor, which is generated by compression of the rubber of the blade, and the shearing force is a force in the rotation direction of the photoreceptor, which is generated by rotation of the photoreceptor. If the shearing force is too strong, the tip of the blade is often turned over. In contrast, if the shearing force is too weak, particles such as toner particles and particles of the circulating agent easily pass through the nip between the blade and the surface of the photoreceptor because the shearing force of the particles is stronger than the shearing force of the blade. As a result of experiments, it is found that when the direction of the resultant stress is not less than 56°, the tip of the blade tends to be turned over, and when the direction is not greater than 35°, the particle passing problem tends to be caused.

In order to form a high quality layer of a circulating agent on the base outermost layer of the photoreceptor, the surface of the base outermost layer is preferably cleaned properly. As a result of the present inventors' experiments and consideration, it is found that when the specific conditions mentioned below are satisfied, a high quality film of the circulating agent can be formed.

Specifically, the specific conditions are such that the tangential force Ft is not less than 1.15 kgf (11.27 N) and not greater than 1.35 kgf (13.23 N), and the ratio Ft/Fn of the tangential force Ft to the normal force Fn is not less than 0.90 and not greater than 0.96. The vector direction of the resultant stress is from 42° to 44° relative to the direction of the normal force.

Zinc stearate is preferably used for forming a circulating outermost layer having good covering effect. This is because zinc stearate has a lamellar structure, and therefore when zinc stearate is rubbed by a blade, the molecules thereof can be spread on the surface of the photoreceptor by a shearing force. In order to remove such a material on the surface of the photoreceptor, a certain shearing force has to be applied thereto. In addition, in order that small particles of the circulating agent pass through the nip between the blade and the surface of the photoreceptor while large particles are blocked by the blade, the blade has to have a certain compression stress. Therefore, in order to control the input-output amount (the input of the circulating agent to the photoreceptor and the output therefrom) so as to be substantially constant, it is necessary to control the tangential force Ft and the normal force Fn so as to fall in preferable ranges. When the above-mentioned conditions (1.15 kgf≤Ft≤1.35 kgf, and 0.90≤Ft/Fn≤0.96) are satisfied, the tangential force Ft and the normal force Fn fall in the preferable ranges.

When the circulating agent is applied in parallel with the image forming process, which includes various disturbances, it is necessary to compensate the loss of the circulating agent caused by the image forming process and the loss caused by contamination of the base outermost layer to control the efficiency of adhesion of the circulating agent to the photoreceptor. The losses can be calculated from the difference in the efficiency of adhesion of the circulating agent between a case where the disturbances are absent and a case where the disturbances are present.

However, in an image forming apparatus in which a circulating outermost layer is formed on a photoreceptor, a preferable range in which the circulating outermost layer can be formed can be determined by performing an experiment in which the consumption (application amount) of the circulating agent is changed, and the property and the number of defects of the film of the applied circulating agent are checked.

Whether or not a satisfactory circulating outermost layer is formed can be determined by performing a running test in which the circulating agent application process is repeatedly performed in combination with the image forming process while checking change in the mass thickness of the circulating outermost layer.

As long as the amount of the circulating agent supplied to the base outermost layer is not greater than the amount of the removed circulating agent, the thickness of the circulating outermost layer does not increase. Specifically, the initial thickness of the circulating outermost layer of a photoreceptor, which is a new photoreceptor and on which application and removal of the circulating agent in combination with the image forming process have been performed predetermined times, and the thickness of the circulating outermost layer of the photoreceptor after repeated use are measured to determine the thickness change. By using this method, whether or not a satisfactory circulating outermost layer is formed can be determined.

Next, the specific method will be described. In this method, it is assumed that the number of rotation of the photoreceptor is the same as the number of application of the circulating agent. In this method, a print test in which the photoreceptor is rotated 2,500 turns and another print test in which the photoreceptor is rotated 25,000 turns are performed, and the mass thickness of the applied circulating agent is measured by an ICP analysis or XRF analysis after the print tests to determine dependence of the mass thickness on the number of application and removal of the circulating agent. The number of rotation of a photoreceptor can be determined by dividing the total running distance by the peripheral length of the photoreceptor. The reason for measuring the thickness after 2,500 turns is as follows. If the number of revolutions is too small, the thickness of the circulating agent layer in a non-stationary state is measured. Therefore, in order to determine the initial thickness of the circulating agent layer, the number of revolutions is set to 2,500. In addition, the reason for measuring the thickness after 25,000 turns is that the number of revolutions is sufficient to evaluate the change of the thickness. In this regard, the number of revolutions (2,500 and 25,000) has a certain amount of flexibility.

It is preferable that at least the following equation (1) is satisfied:

$$\tau = f\alpha + \beta \quad (1),$$

wherein $\tau$ is the mass thickness of the circulating agent in units of nanometer, f represent a proportionality coefficient, which is preferably not greater than 0 and not less than −0.1 (i.e., $-0.1 \le f \le 0$), a represents the number of application of the circulating agent (when the photoreceptor is a drum, the number of revolutions of the drum in units of thousand turns), and $\beta$ represents a constant.

The upper limit (0) of the coefficient f is important because the amount of the applied circulating agent does not exceed the amount of the removed circulating agent. In addition, when the coefficient is not less than the lower limit (−0.1), the surface of the photoreceptor can stably maintain good durability.

The above-mentioned tangential force and normal force of a blade are conventionally controlled by controlling the contact angle, digging amount, and constitutional materials of the blade. However, it is not easy to adjust the tangential force after setting the normal force to a predetermined value. This is because the relationship between the tangential force and the normal force is that when the digging amount of the blade is increased, the normal force is increased and reaches to the yield point, resulting in exponential increase of the tangential force. In particular, when the above-mentioned three-dimensionally crosslinked resin layer is used for the outermost layer, change of the acting force is large when changing the digging amount, and therefore it is very difficult to adjust the acting force.

The present inventors consider that by controlling the shape of the surface of the photoreceptor, this adjustment can be easily performed. This was verified as mentioned below.

Specifically, the photoreceptor of the image forming apparatus of this disclosure includes an electroconductive support, and a photosensitive layer, a base outermost layer, and a circulating outermost layer, which are overlaid on the electroconductive support in this order. The base outermost layer satisfies the following requirements in order to improve the conformability (fittability) of the blade with the base outermost layer.

Figure 17:
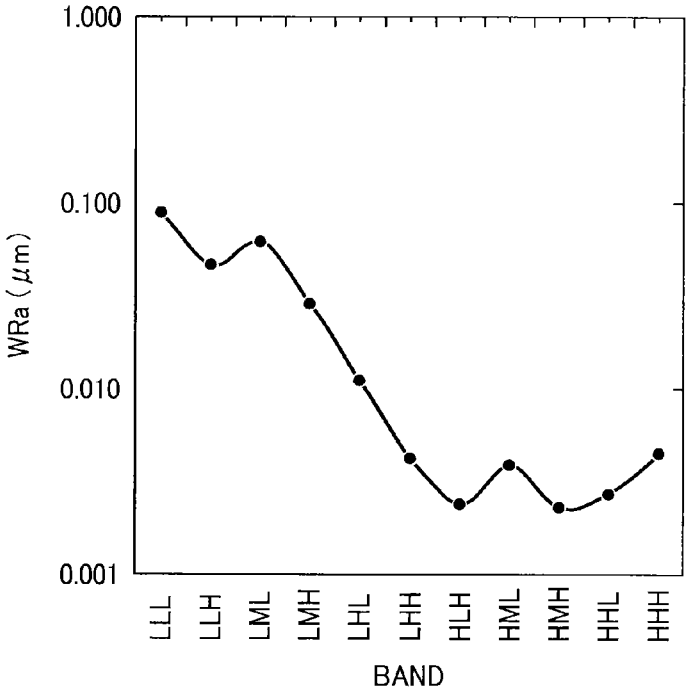
FIG. 17 illustrates an example of roughness spectrum.
Figure 18:
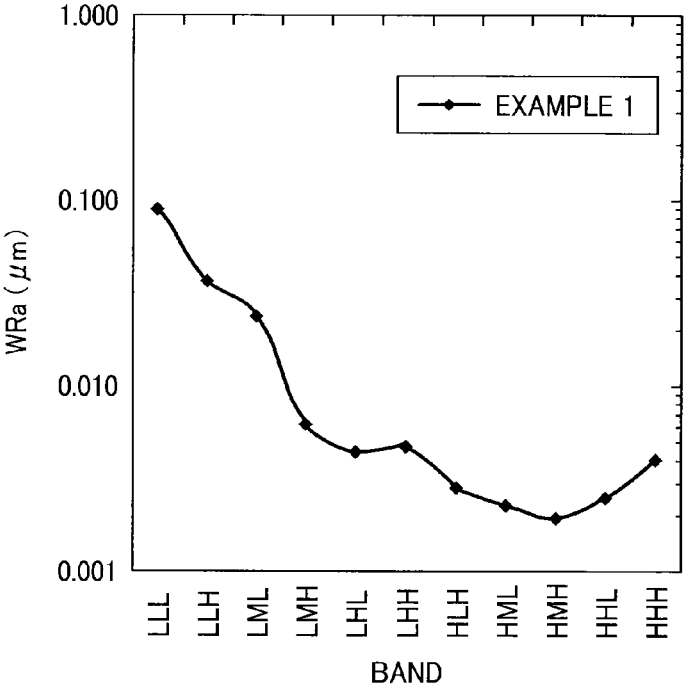
FIG. 18 illustrates another example of roughness spectrum.
Figure 19:
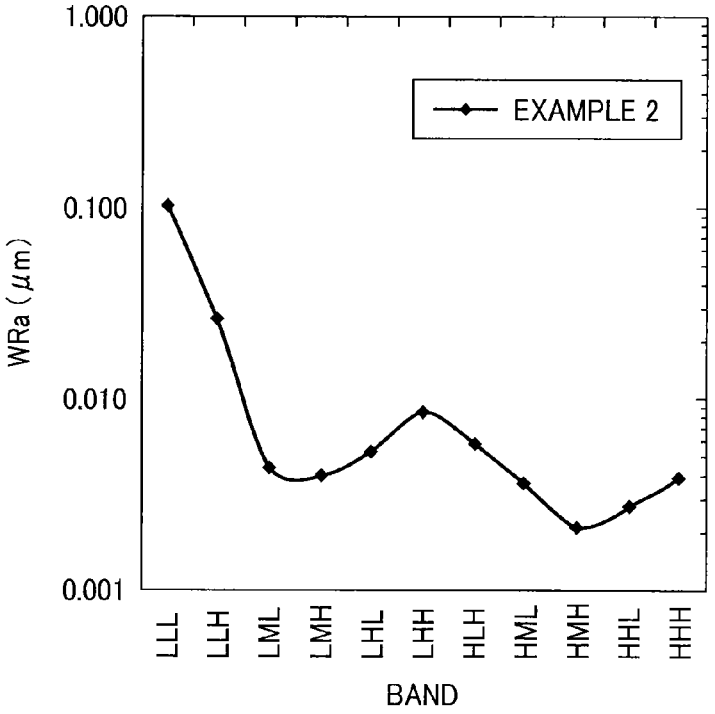
FIG. 19 illustrates another example of roughness spectrum.
Figure 20:
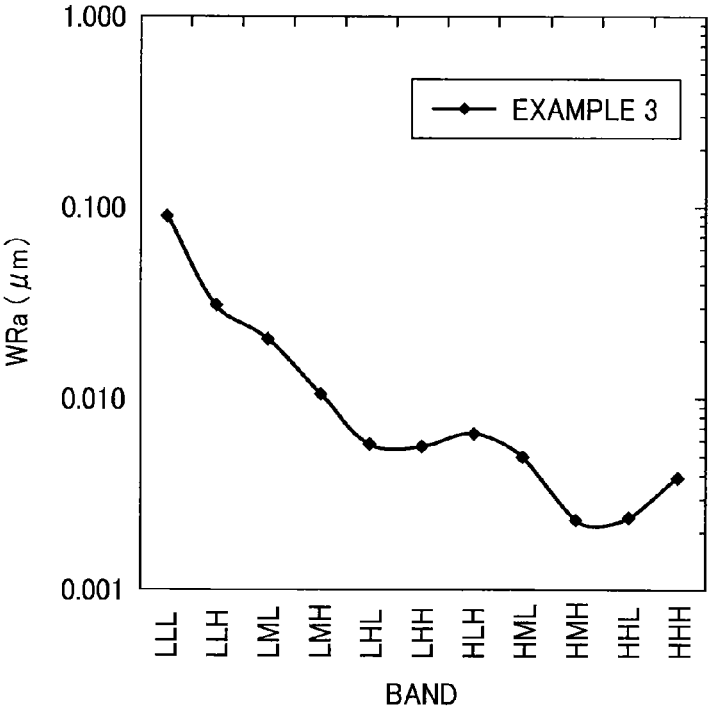
FIG. 20 illustrates another example of roughness spectrum.
Figure 21:
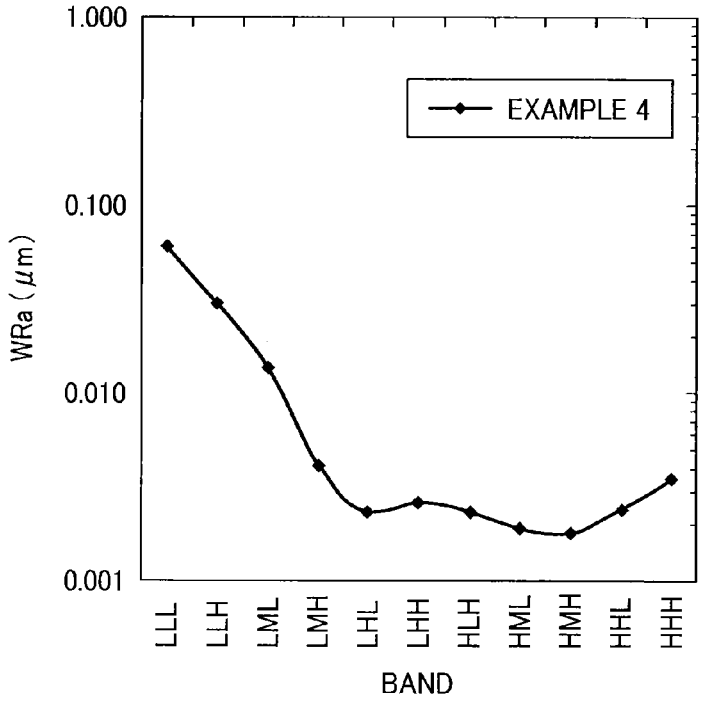
FIG. 21 illustrates another example of roughness spectrum.
Figure 22:
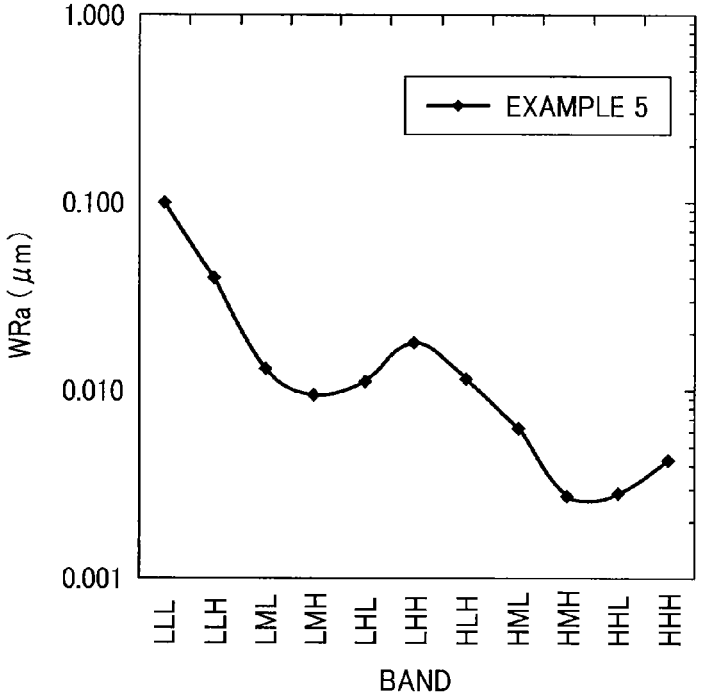
FIG. 22 illustrates another example of roughness spectrum.
Figure 23:
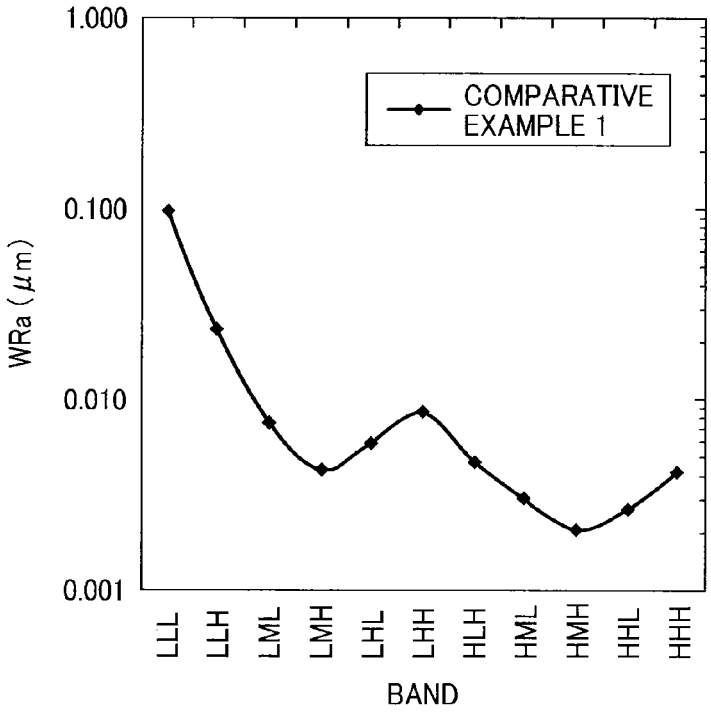
FIG. 23 illustrates another example of roughness spectrum.
Figure 24:
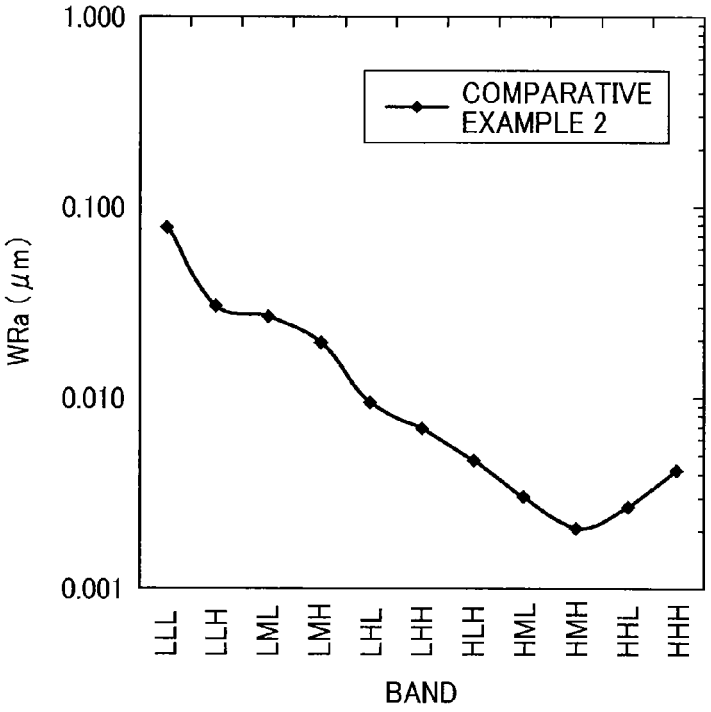
FIG. 24 illustrates another example of roughness spectrum.

Specifically, in order to determine the shape of the surface (profile) of the base outermost layer, the Arithmetical Mean Deviation of the Profile (WRa) of each of twelve frequency components (LLL to HHH) is obtained by following the procedures (I) to (V) below. In this regard, the twelve frequency components are LLL, LLH, LML, LMH, LHL, LHH, HLL, HLH, HML, HMH, HHL and HHH. Next, the logarithmic value of each of eleven WRa data (except for the WRa (HLL)) is obtained, and the eleven logarithmic data are plotted in a graph to obtain a curve (hereinafter referred to as a roughens spectrum) as illustrated in FIG. 17. In this regard, requirements such that the curve does not have a folding point in a range of from LLL to LHL, the WRa(LLH) is less than 0.04 μm, and the WRa(HLH) is less than 0.005 μm are satisfied.

(I) The surface roughness and profile of the base outermost layer are measured with a surface roughness/profile measuring instrument to prepare a one-dimensional data array.

(II) The one-dimensional data array is subjected to wavelet transformation by a multi-resolution analysis to separate the data array into six frequency components of from a high frequency component to a low frequent component (i.e., HHH, HHL, HMH, HML, HLH and HLL).

(III) In addition, a one-dimensional data array is prepared by thinning the one-dimensional data array of the minimum frequency component (HLL) so that the number of data array is reduced to 1/10 to 1/100.

(IV) The one-dimensional data array is subjected to wavelet transformation by a multi-resolution analysis to separate the data array into six frequency components of from a high frequency component to a low frequent component (i.e., LHH, LHL, LMH, LML, LLH and LLL).

(V) The Arithmetical Mean Deviation of the Profile (WRa) of each of the thus obtained twelve frequency components (HHH to LLL) is obtained.

In this regard, the Arithmetical Mean Deviation of the Profile of each of bands (which are separated with respect to the frequency (i.e., length of one convex-concave cycle) obtained by subjecting the Arithmetical Mean Deviation of the Profile (Ra) (defined in JIS-B0601:2001) of the base outermost layer of the photoreceptor to wavelet transformation are the following.

WRa(HHH): Ra of the band in which the length of one convex-concave cycle is 0.3 μm to 3 μm.

WRa(HHL): Ra of the band in which the length of one convex-concave cycle is 1 μm to 6 μm.

WRa(HMH): Ra of the band in which the length of one convex-concave cycle is 2 μm to 13 μm.

WRa(HML): Ra of the band in which the length of one convex-concave cycle is 4 μm to 25 μm.

WRa(HLH): Ra of the band in which the length of one convex-concave cycle is 10 μm to 50 μm.

WRa(HLL): Ra of the band in which the length of one convex-concave cycle is 24 μm to 99 μm.

WRa(LHH): Ra of the band in which the length of one convex-concave cycle is 26 μm to 106 μm.

WRa(LHL): Ra of the band in which the length of one convex-concave cycle is 53 μm to 183 μm.

WRa(LMH): Ra of the band in which the length of one convex-concave cycle is 106 μm to 318 μm.

WRa(LML): Ra of the band in which the length of one convex-concave cycle is 214 μm to 551 μm.

WRa(LLH): Ra of the band in which the length of one convex-concave cycle is 431 μm to 954 μm.

WRa(LLL): Ra of the band in which the length of one convex-concave cycle is 867 μm to 1654 μm.

The present inventors discover that when the base outermost layer satisfies the above-mentioned conditions, the circulating agent can be efficiently applied. The reason therefor is not yet determined, but is considered to be as follows.

Specifically, a circulating outermost layer cannot be formed on the base outermost layer if the application blade perfectly blocks the circulating agent on the base outermost layer. Therefore, in order to form a circulating outermost layer having a proper thickness, it is necessary to form a dynamic gap between the application blade and the base outermost layer so that the circulating agent moderately passes through the gap. For example, in a case where a rubber application blade is contacted with the photoreceptor to apply a circulating agent, the circulating agent is blocked by the application blade if the application blade is contacted with the photoreceptor in the same manner as that of a cleaning blade, resulting in performance of wobbly coating. In order to perform coating of a circulating agent, it is insufficient only to control of the condition of contact of the application blade with the photoreceptor, and it is necessary to control the rubbing condition of the blade for the photoreceptor as well as the contact condition control. In this regard, the contact condition means a condition under which the blade is contacted with the photoreceptor, and the rubbing condition means a condition under which the blade rubs the photoreceptor.

In general, the conditions under which a homogeneous film of a coating liquid can be formed are as follows.

(1) The gap between a blade and a surface to be coated is always uniform to form a liquid layer having a uniform thickness;

(2) The blade does not cause vibration or the like;

(3) The coating speed is constant;

(4) The surface to be coated is clean; and (5) The coating liquid is homogeneous.

The same is true for formation of a uniform circulating agent layer.

Specifically, by controlling the conditions of the surface of the surface of the photoreceptor as mentioned above, coating of the circulating agent can be well performed. In this regard, one of the important factors is that the application blade is made of a rubber.

When the base outermost layer having such a surface as mentioned above, the surface can be satisfactorily cleaned, and coating properties of a circulating agent can be dramatically enhanced. By efficiently performing application of the circulating agent, consumption of the circulating agent can be reduced.

In order to form a circulating outermost layer on the surface of the photoreceptor satisfying the above-mentioned conditions, it is preferable that the circulating agent can be easily removed from the surface of the photoreceptor and can be easily applied to the surface of the photoreceptor. In order to maintain the circulating outermost layer, the amount of the applied circulating agent in a cycle is preferable equivalent to the amount of the removed circulating agent in the cycle.

In addition, it is preferable that the consumption rate of the circulating agent is not excessive. In this regard, the consumption rate is defined as a ratio of the input (kg) of the circulating agent to the running distance (km) and has a unit of kg/km.

Waxes and higher fatty acid metal salts are preferably used for forming a good circulating outermost layer on the surface of the photoreceptor satisfying the above-mentioned conditions. Specific examples of such waxes include vegetable waxes such as sumac wax, lacquer wax, palm wax, and carnauba wax; animal waxes such as beeswax, whale wax, pivet wax, and wool wax; and mineral waxes such as montan wax, and paraffin wax.

Particularly, higher fatty acid metal salts, which have been conventionally used, are preferable because of having good properties. Among these, zinc stearate is representative thereof, and can have a lamellar structure such that a layer of regularly folded molecules is overlaid.

The lamellar structure is a layered structure in which amphiphilic molecules are self-assembled. When a shearing force is applied thereto, the crystal is easily cracked along the interface between layers. This property can be preferably used for forming a circulating outermost layer. Specifically, when zinc stearate having a lamellar structure receives a shearing force, zinc stearate can well cover the surface of the photoreceptor even when the application amount is relatively small.

When a circulating agent is applied by this method, various methods can be used for controlling the condition of the applied circulating agent. For example, a method in which the contact pressure of the application brush contacted with a solid circulating agent is increased, or a method in which the rotation speed of the application brush is increased can be used. In addition, a method in which the revolution of the application brush is controlled based on the information on the image to be produced can also be used. Waxes and higher fatty acid metal salts can be used alone as the circulating agent. In addition, the circulating agent can further include another functional material such as charge transport materials and antioxidants while using a wax or a higher fatty acid as a binder.

By using such materials for the circulating agent, a circulating outermost layer which can be easily formed and removed in such a manner that the amount of the applied circulating agent in a cycle is equivalent to the amount of the removed circulating agent in the cycle can be formed. In addition, a simple device can be used for applying and removing the circulating agent. By using such a circulating agent, a circulating outermost layer can be repeatedly formed over a long period of time. Further, by applying such a circulating agent on such a base outermost layer as mentioned above, the covering ability of the circulating outermost layer per one cycle can be dramatically enhanced, thereby making it possible to reduce the consumption of the circulating agent.

Fatty acid metal salts having a lamellar structure are preferably used as the circulating agent. Specific examples thereof include zinc, aluminum, calcium, magnesium and lithium salts of stearic acid, palmitic acid, myristic acid, and oleic acid. These materials can be used alone or in combination.

In particular, zinc stearate is industrially produced, and is used for various fields. Therefore, zinc oxide is more preferable from the viewpoints of cost, quality, stability and reliability. In addition, zinc stearate has an advantage such that various conventional coating technologies of coating zinc stearate can be used.

In general, a fatty acid metal salt used industrially includes another fatty acid metal salt, a metal oxide, and a free fatty acid as well as the named compound. Such a fatty acid metal salt can also be used for the circulating agent.

By using such a circulating agent, a circulating outermost layer can be formed with high reliability and a low cost. In addition, various conventional coating technologies of coating zinc stearate can be used when designing the circulating agent applicator or the like device.

Since the surface of the base outermost layer of the photoreceptor has the above-mentioned specific shape, the effect to satisfactorily apply the circulating agent to the surface of the photoreceptor can be enhanced. In order to maintain the effect, the strength of the base outermost layer is preferably enhanced. If the surface of a photoreceptor is abraded by repeatedly used for image formation, the profile of the surface of the photoreceptor is changed. It is possible to find the change of the profile from the surface roughness. Specifically, the present inventors confirmed that as the surface of a photoreceptor is abraded, the surface roughness of the photoreceptor increases.

In order to form the above-mentioned specific surface shape, the base outermost layer is preferably formed by a wet process (i.e., a process in which a coating liquid is applied). Specifically, by using a wet process, the surface shape on the order of micrometers and millimeters can be controlled. The wet process is superior to a mechanical process in technology and costs. In a wet process, the viscosity of the coating liquid is preferably low because the surface shape controlling can be easily performed. Specifically, the viscosity is preferably from 0.9 mPa·s to 10 mPa·s. The lower limit of the viscosity is determined based on the viscosity of the solvent used (i.e., the lower limit is close to the viscosity of the solvent). In order that the viscosity of the coating liquid is low and the resultant base outermost layer has a sufficient strength, it is preferable to use, as a main component, a reactive resin monomer capable of forming a three-dimensionally crosslinked structure for the coating liquid.

By using a resin having a three-dimensionally crosslinked structure for the base outermost layer, the base outermost layer can have a good abrasion resistance. This is because when part of a chemical bond of the resin film of the base outermost layer is cut due to repeated use of the photoreceptor, the resin film is hardly abraded if the other part of the chemical bond remains. The base outermost layer having a good abrasion resistance can maintain the surface shape. Therefore, when a resin having a three-dimensionally crosslinked structure is used for the base outermost layer, the base outermost layer can maintain the surface shape, and a good circulating outermost layer can be stably formed on the base outermost layer.

Among resins having a three-dimensionally crosslinked structure, acrylic resins are preferable because acrylic resins have a higher dielectric constant than a solid solution of a polycarbonate and a charge transport material, and therefore the electrostatic properties of the base outermost layer are less influenced by the roughened surface than in a case where a solid solution of a polycarbonate and a charge transport material is used.

Thus, by using a resin having a three-dimensionally crosslinked structure, it becomes easy to control the surface shape of the base outermost layer. Therefore, the coating property of the circulating agent can be easily enhanced. In addition, change of the surface shape of the base outermost layer can be prevented, and therefore the coating property of the circulating agent can be stably maintained.

By including a filler in a base outermost layer coating liquid having a relatively low viscosity, a base outermost layer having roughened surface can be easily prepared. In this regard, by controlling the decree of aggregation of the filler, the surface shape can be easily changed. It is conventionally known that a combination of a three-dimensionally crosslinked resin and a filler is used for the outermost layer of a photoreceptor. However, the main purpose of the technique is to enhance the mechanical strength of the outermost layer, and a technique in that a dispersant of the filler is included in such a coating liquid is hardly proposed. The present inventors' idea such that the decree of aggregation of a filler in a coating liquid is controlled by using a dispersant to control the shape of the surface of the photoreceptor is considered to be new. Among fillers, metal oxide fillers having an average primary particle diameter on the order of nanometers are preferable, and α-alumina, tin oxide, titanium oxide, silica, and cerium oxide are preferable among metal oxides.

Some particulate organic and inorganic materials cannot be well dispersed in a coating liquid. If these materials are used for the outermost layer, the resultant layer has a surface roughness on the order of micrometers or more. In addition, there are materials which have spine on the surface thereof. If these materials are used for the base outermost layer, the outermost layer damages a blade such as an application blade. In contrast, metal oxide fillers tend not to cause these problems. For the reason mentioned above, the content of a metal oxide in the base outermost layer is preferably from 1 to 20% by weight based on the total weight of the base outermost layer. When the content is in the range, it is easy to control the surface shape of the base outermost layer. In addition, by using a metal oxide for the base outermost layer, the mechanical strength of the layer can be enhanced.

Among various dispersants, phosphoric acid ester type dispersants are preferable because of having advantages such that a filler can be stably dispersed in a coating liquid by the dispersant in such a manner that the dispersed filler particles have a small particle diameter, and the affinity of the filler for the binder resin used can be enhanced thereby. By properly controlling the filler dispersing effect and the affinity enhancing effect, the surface shape of the base outermost layer can be controlled. Specifically, in this control, a dispersant having a proper acid value and an amine value is selected depending on the property (such as acidic or basic property) of the filler used. Alternatively, it is preferable to select a dispersant including a component which can enhance the affinity of the filler for the binder resin used. In order to stably produce a base outermost layer, it is preferable that a filler is stably dispersed in a base outermost layer coating liquid. In order to stably disperse a filler in a base outermost layer coating liquid, a dispersant having a functional group to be adsorbed on the filler or a dispersant which has good compatibility with a solvent used for the coating liquid is preferably used. The added amount of a dispersant is preferably from 1 to 2% by weight based on the weight of the solid components of the base outermost layer from the viewpoint of the electrostatic properties of the resultant photoreceptor.

As mentioned above, by using a phosphoric acid ester type dispersant and a metal oxide filler for the base outermost layer coating liquid, a base outermost layer having a desired surface shape can be easily formed, and therefore a good circulating outermost layer can be formed on the base outermost layer. In addition, the abrasion resistance of the base outermost layer can be enhanced.

When coating of the circulating agent is insufficient, a film or a fish-form film including toner components and paper dust is formed on the surface of the photoreceptor. In this case, the wettability of the base outermost layer is changed, and thereby the desired circulating layer formation and removal cannot be performed. When a particulate α-alumina having substantially a spherical form is included in the base outermost layer, chance of occurrence of the filming problem can be dramatically reduced.

The reason therefor is not yet determined but is considered to be as follows. Since α-alumina has high hardness, α-alumina produces an effect to prevent the base outermost layer from being scratched. This effect reduces chance of formation of a film on the base outermost layer. In addition, it is considered that even when an insufficient amount of circulating agent is applied on the base outermost layer, rubbing the surface of the photoreceptor with the blade is hardly changed because convexes and concaves formed by α-alumina can keep the good contact state to an extent.

The volume average primary particle diameter of α-alumina is preferably from 0.01 μm to 2.0 μm, and more preferably from 0.03 μm to 1.5 μm. In this case, formation of spine-form projections on the base outermost layer can be prevented, and the resultant base outermost layer can satisfy the requirements such that WRa(LLH) is less than 0.04 μm, and WRa(HLH) is less than 0.005 μm.

As mentioned above, by including α-alumina having a volume average particle diameter of from 0.01 μm to 2.0 μm in the base outermost layer, change of properties of the surface of the photoreceptor can be prevented, thereby making it possible to stably form a good circulating outermost layer on the surface of the photoreceptor. As mentioned below, the volume average primary particle diameter of α-alumina is even more preferably from 0.2 μm to 0.5 μm An example of the image forming apparatus using a circulating agent will be described by reference to FIG. 8. In the image forming apparatus illustrated in FIG. 8, a circulating agent 3A is supplied to a surface of the photoreceptor 11 by an application brush 3B, and the applied circulating agent is smoothed by an application blade 3C to form a circulating outermost layer 29 on the surface of the photoreceptor. After passing a charger 12 and a developing device 14, the circulating outermost layer is removed by the cleaning blade 17. The circulating outermost layer formation and removal are repeated. Since supply and removal of toner are performed on the surface of the photoreceptor, the circulating outermost layer typically includes the toner as well as the circulating agent.

Figure 8:
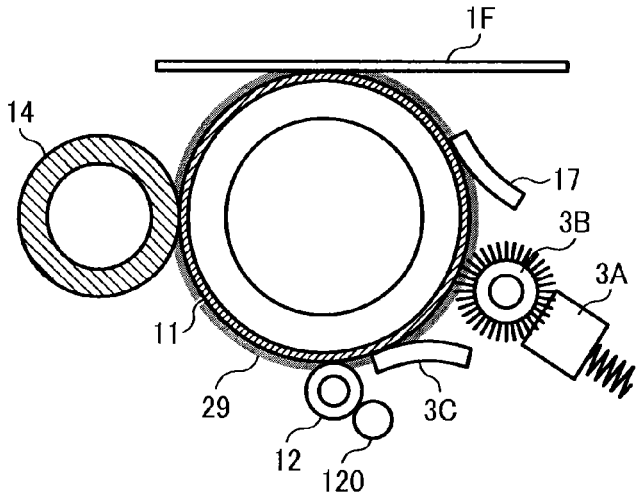
FIG. 8 is a schematic cross-sectional view illustrating another image forming apparatus according to an embodiment.

A cleaner 120 is provided so as to be contacted with the charger 12 to clean the surface of the charger. In FIG. 8, numeral 1F denotes an intermediate transfer medium to which a toner image formed on the photoreceptor 11 is transferred.

Figure 7:
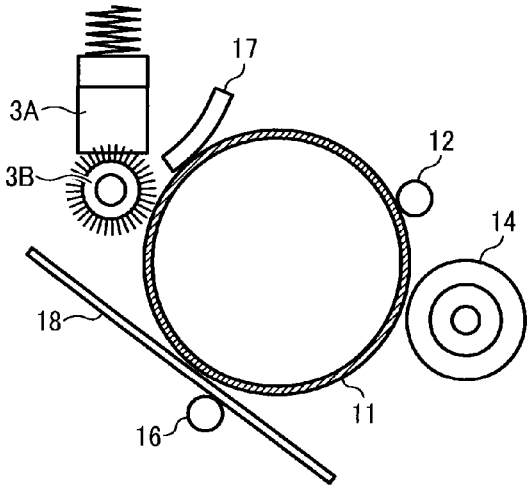
FIG. 7 is a schematic cross-sectional view illustrating another image forming apparatus according to an embodiment.

As illustrated in FIG. 7, the image forming apparatus of this disclosure may use an image forming method in which a toner image on the photoreceptor 11 is directly transferred onto a recording medium 18 by a transferring device 16 without using the intermediate transfer medium 1F.

In order to enhance the circulating efficiency of the circulating agent, it is preferable that the circulating agent is well adhered to the surface of the photoreceptor, the circulating agent is well spread on the surface of the photoreceptor, and the circulating agent is easily removed from the surface of the photoreceptor. Smoothing (spreading) of the circulating agent is typically performed by an application blade, and removal of the circulating agent is typically performed by a cleaning blade. Therefore, it is preferable for the blades to achieve a stable contact/rubbing state with the surface of the photoreceptor.

In order that the blades achieve a stable contact/rubbing state, the requirements that the WRa (LLH) is less than 0.04 μm, and the WRa (HLH) is less than 0.005 μm are preferably satisfied. In this case, roughening of the contact surface of the blades can be prevented.

When a crosslinked resin having a good abrasion resistance is used for the base outermost layer, the resultant base outermost layer has a good abrasion resistance, and in addition the surface shape of the layer can be maintained. This is because even when part of a chemical bond of the resin film of the base outermost layer is cut due to repeated use of the photoreceptor, the resin film is hardly abraded if the other part of the chemical bond remains.

Among resins having a three-dimensionally crosslinked structure, acrylic resins are preferable because acrylic resins have a higher dielectric constant than a solid solution of a polycarbonate and a charge transport material, and therefore the electrostatic properties of the base outermost layer is less influenced by the roughened surface than in a case where a solid solution of a polycarbonate and a charge transport material is used.

The image forming apparatus preferably has a mechanism which scrapes a circulating agent with a brush to supply the scraped circulating agent to the surface of the photoreceptor. By using such a mechanism, the consumption of the circulating agent can be easily controlled, and the circulating agent can be applied to the entire surface of the photoreceptor. In addition, it is preferable to provide an application blade, which rubs the surface of the photoreceptor, on a downstream side form the brush and an upstream side from the cleaning blade relative to the moving direction of the photoreceptor. By using such an application blade, the amount of the circulating agent supplied to the surface of the photoreceptor can be controlled while the circulating agent is smoothed and speared on the surface of the photoreceptor. The brush and application blade are effective at controlling the circulation of the circulating agent.

Hereinafter, the multi-resolution analysis of a profile curve of a photoreceptor will be described.

In this analysis, initially a profile curve (described in JIS B0601) of a photoreceptor is obtained, wherein the profile curve is a one-dimensional data array. The one-dimensional data array can be obtained from digital signals output from a surface roughness/profile measuring instrument. Alternatively, it is possible to subject analogue output from a surface roughness/profile measuring instrument to analogue-digital conversion.

The length of a measurement portion of the photoreceptor (measurement length) is preferably the length described in JIS B0601, and is a length of from 8 mm to 25 mm.

In addition, the sampling interval is preferably not greater than and more preferably from 0.2 μm to 0.5 μm. For example, it is preferable that the measurement length is 12 mm, and the number of measurement points is 30720, wherein the sampling interval is 0.390625 μm.

This one-dimensional data array is subjected to wavelet transformation (MRA-1) to perform a multi-resolution analysis, i.e., to separate the one-dimensional data array to plural frequency components of from a high frequency component (HHH) to a low frequency component (LLL) (for example, six components (HHH), (HHL), (HMH), (HML), (HLH) and (FILL)). In addition, a one-dimensional data array is prepared by thinning the one-dimensional data array of the minimum frequency component (FILL) so that the number of data array is reduced to 1/10 to 1/100. The thus obtained one-dimensional data array is subjected to wavelet transformation (MRA-2) to perform a multi-resolution analysis, i.e., to separate the data into six frequency components of from a high frequency component to a low frequent component (i.e., LHH, LHL, LMH, LML, LLH and LLL). The Arithmetical Mean Deviation of the Profile (WRa) of each of the thus obtained twelve frequency components (LLL to HHH) is obtained. In this application, in order to clarify this Arithmetical Mean Deviation of the Profile from the general Arithmetical Mean Deviation of the Profile (Ra) defined in JIS B0601, the Arithmetical Mean Deviation of the Profile is referred to as WRa.

In the present application, the wavelet transformation is performed using software MATLAB. In this regard, the band width is determined depending on the software, and therefore the band width does not have special meaning. Since the WRa depends on the band width, the WRa changes if the band width is changed.

In addition, the frequency range overlaps between HML and HLH, LHL and LMH, LMH and LML, LML and LLH, and LLH and LLL. The reason therefor is as follows.

Specifically, in the wavelet transformation, an original signal is decomposed to L (Low-pass Components) and H (high-pass Components) in the first wavelet transformation (Level 1), and then the L is subjected to the wavelet transformation to decompose the L to LL and HL. In this regard, when the frequency component f is identical to the separation frequency F, the frequency f is the boundary in separation, and therefore the frequency is separated into the L and H. This phenomenon is unavoidable in the multi-resolution analysis. Therefore, it is preferable that the frequencies included in the original signal are properly set so that the frequency band to be observed is not separated in the wavelet transformation.

In the multi-resolution analysis, the wavelet transformation is performed twice, and the first wavelet transformation is sometimes referred to as MRA-1, and the second wavelet transformation is sometimes referred to as MRA-2. In order to distinguish between the MRA-1 and MRA-2, a prefix H (for MRA-1) or L (for MRA-2) is attached to each frequency band.

Various wavelet functions such as Daubecies function, Haar function, Meyer function Symlet function and Coiflet function can be used for the mother wavelet function used for the MRA-1 and the MRA-2. In this application, the Haar function is used, but the mother wavelet function is not limited thereto.

When the multi-resolution analysis in which the data is separated into plural frequency components of from a high frequency component to a low frequency component using the wavelet transformation is performed, the number of the plural frequency components is preferably from 4 to 8, and more preferably 6.

In the multi-resolution analysis, initially the MRA-1 is performed to separate the data into plural frequency components, and then the minimum frequency component is sampled while thinned to prepare a one-dimensional data array on which the data of the minimum frequency component is reflected. The thus prepared one-dimensional data array is subjected to the MRA-2 using wavelet transformation to separate the date into plural frequency components of from a high frequency component to a low frequency component.

The thinning operation performed on the minimum frequency component obtained in the MRA-1 is characterized in that the number of data arrays is reduced to 1/10 to 1/100.

In this regard, the data thinning produces an effect to increase the frequency of data (i.e., to widen the width of the logarithmic scales on the horizontal axis in the graph). For example, when the number of the arrays of the one-dimensional data array obtained in the MRA-1 is 30,000, the number of arrays is reduced to 3,000 if a 1/10 thinning process is performed. In this regard, if the thinning rate of the thinning process is less than 10 (for example, a 1/5 thinning processing is performed), the data frequency increasing effect is small. In this case, even when the MRA-2 using wavelet transformation is performed, the data cannot be well separated.

In contrast, if the thinning rate of the thinning process is greater than 100, the data frequency excessively increases. In this case, even when the MRA-2 using wavelet transformation is performed, the data cannot be well separated because of being concentrated to the high frequency component.

The method of thinning data is that if a 1/100 thinning processing is performed, 100 data are averaged and the average is used as a representative of the 100 data.

Figure 12:
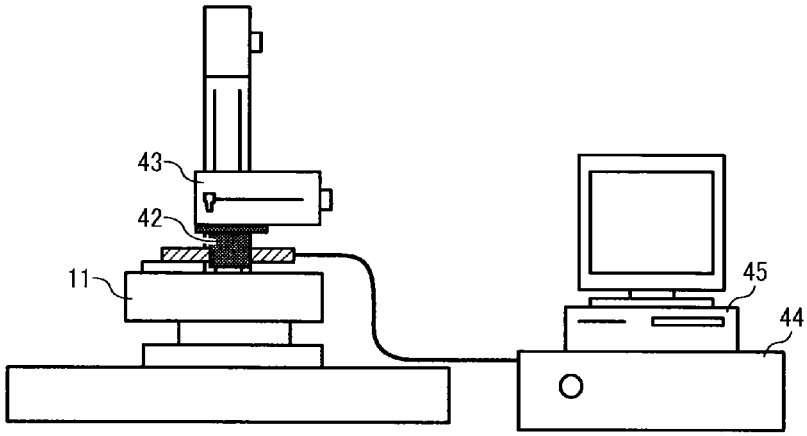
FIG. 12 is a schematic view illustrating a surface roughness and profile measuring system.

FIG. 12 is a schematic view illustrating a surface roughness and profile measuring system. Referring to FIG. 12, numeral 11 denotes a sample (photoreceptor) to be measured, numeral 42 denotes a jig to which a surface roughness measuring probe is attached, numeral 43 denotes a mechanism to move the jig 42 along the surface of the sample, numeral 44 denote a surface roughness and profile measuring instrument, and numeral 45 denotes a personal computer to perform a signal analysis. In this system, the personal computer 45 performs calculations in the above-mentioned multi-resolution analysis. When the sample 11 is a cylindrical photoreceptor, the surface roughness of the photoreceptor in any direction such as the circumferential direction and the axis direction can be measured.

The system illustrated in FIG. 12 is an example, and the surface roughness and profile measuring system is not limited thereto. For example, the device to perform the above-mentioned multi-resolution analysis is not limited to a personal computer, and for example, a numerical calculation processor can also be used. In addition, the processing may be performed by the surface roughness and profile measuring instrument itself. The method of displaying the results is not particularly limited, and the results may be shown in a CRT or a liquid crystal display. Alternatively, the results may be printed out. Further, the results may be transmitted to another device as electric signals, or may be stored in a USB (universal serial bus) memory or a MO (magnetoptic) disc.

In this application, SURFCOM 1400D from Tokyo Seimitsu Co., Ltd. is used as the surface roughness and profile measuring instrument 44, a personal computer from International Business Machine Corporation is used for the personal computer 45, and SURFCOM 1400D is connected with the personal computer using a cable RS-232-C. Processing of the data of surface roughness sent from SURFCOM 1400D to the personal computer and calculation in the multi-resolution analysis are performed using software prepared by the present inventors using C language.

Next, the procedure of the multi-resolution analysis of the profile of a surface of a photoreceptor will be described by reference to a specific example.

The profile of a photoreceptor was obtained using an instrument, SURFCOM 1400D from Tokyo Seimitsu Co., Ltd.

The measurement length in the first measurement was 12 mm, and the number of sampling points was 30720. In one measurement, profiles of four portions of the surface of the photoreceptor were obtained. The profile data were sent to a personal computer, and then subjected to a first wavelet transformation (MRA-1) using a program prepared by the present inventors. The minimum frequency component obtained in the MRA-1 was subjected to a 1/40 thinning processing, followed by a second wavelet transformation (MRA-2).

Next, the Arithmetical Mean Deviation of the Profile (WRa), the maximum height (Rmax) and the ten-point mean roughness (Rz) of each of the frequency components obtained in the first and second multi-resolution analyses were determined. An example of the result is shown in FIG. 13.

Figure 13:
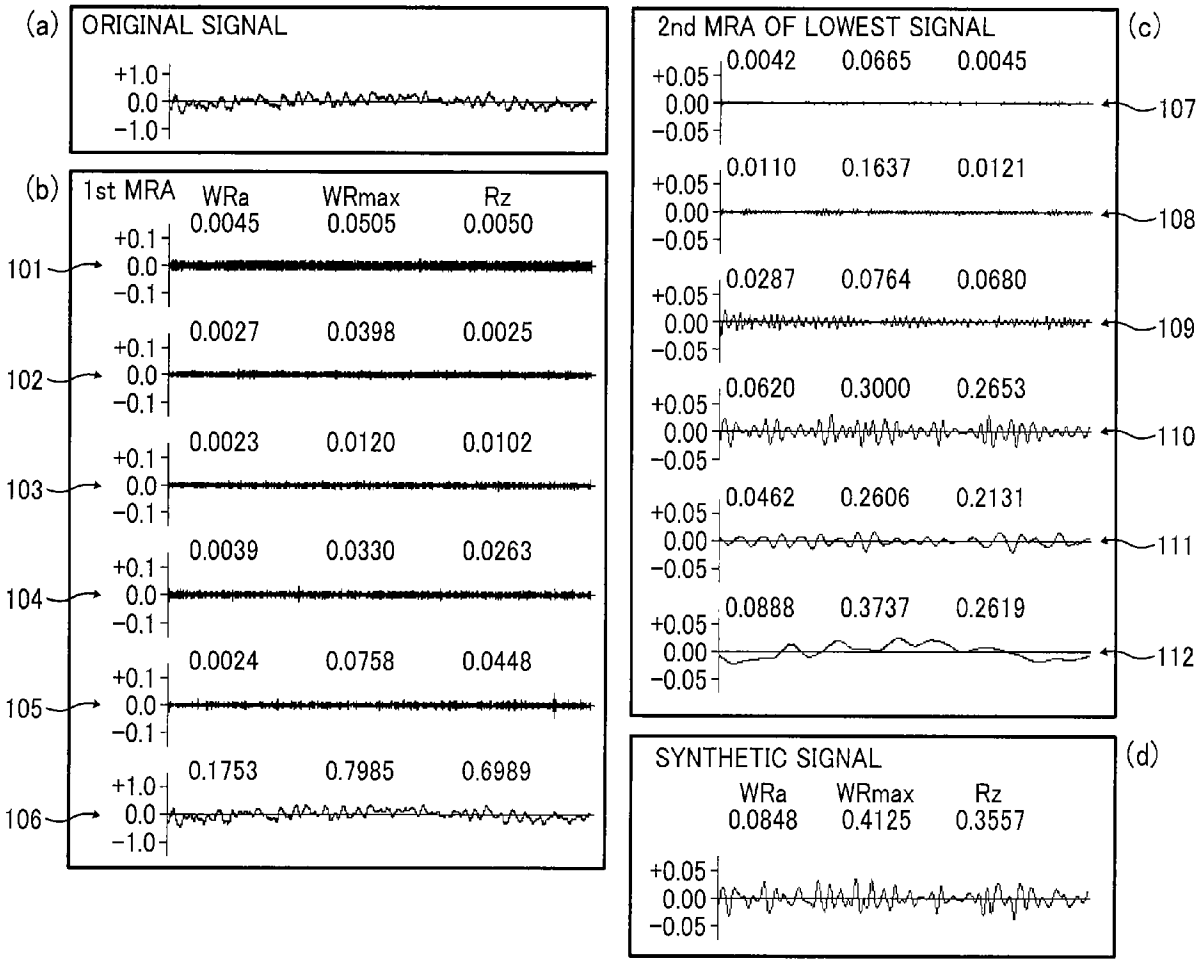
FIGS. 13(*a*)-13(*d*) illustrate a result of a multi-resolution analysis using wavelet transformation.

FIG. 13(*a*) illustrates original data obtained by the instrument, SURFCOM 1400D. The data is sometimes referred to as a roughness curve or a profile curve.

FIG. 13 includes 14 graphs, in which the displacement (in units of μm) is plotted on the vertical axis, and the length (measurement length) is plotted on the horizontal axis. Although the scale is not illustrated on the horizontal axis, the measurement length is 12 mm.

In conventional surface roughness measurements, the Arithmetical Mean Deviation of the Profile (Ra), the maximum height (Rmax) and the ten-point mean roughness (Rz) of the sample are obtained from the roughness curve illustrated in FIG. 13(*a*).

The six graphs in FIG. 13(*b*) illustrate the results of the MRA-1. In FIG. 13(*b*), the uppermost graph is a graph of the maximum frequency component (HHH), and the lowermost graph is a graph of the minimum frequency component (HLL).

In FIG. 13(*b*), numeral 101 denotes a graph of the maximum frequency component (HHH) in the MRA-1. Numeral 102 denotes a graph of a frequency component (HHL) one rank lower than the HHH in the MRA-1. Numeral 103 denotes a graph of a frequency component (HMH) two ranks lower than the HHH in the MRA-1. Numeral 104 denotes a graph of a frequency component (HML) three ranks lower than the HHH in the MRA-1. Numeral 105 denotes a graph of a frequency component (HLH) four ranks lower than the HHH in the MRA-1. Numeral 106 denotes a graph of a minimum frequency component (HLL) in the MRA-1.

In this analysis, the graph illustrated in FIG. 13(*a*) is separated into six graphs illustrated in FIG. 13(*b*) based on the frequency. This frequency separation is illustrated in FIG. 14.

Figure 14:
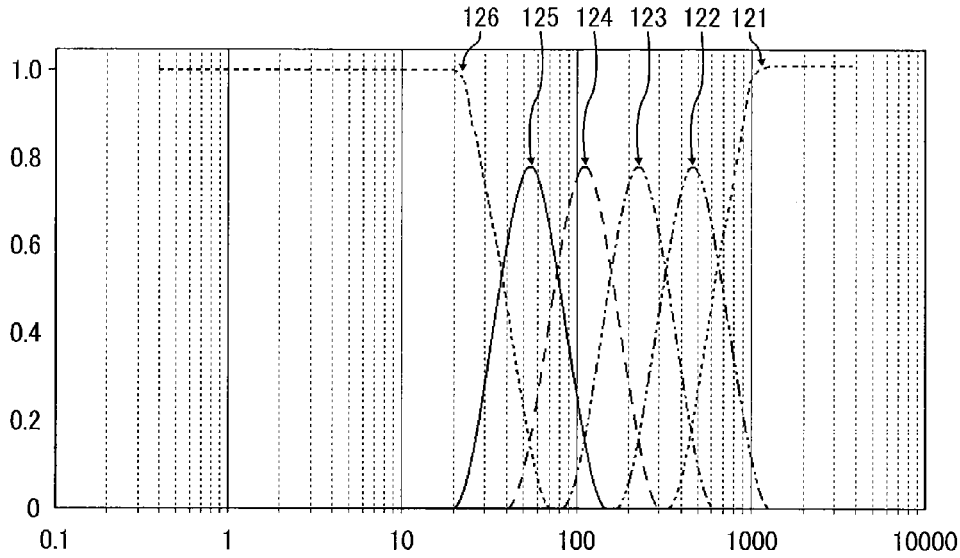
FIG. 14 illustrates frequency bands separated in the first multi-resolution analysis.

In FIG. 14, the number of convexes and concaves in a length of 1 mm is plotted on the horizontal axis, wherein it is assumed that the shape of the convexes and concaves is sine-wave. In addition, the proportion is plotted on the vertical axis when the band separation is performed.

In FIG. 14, numeral 121 denotes the band of the HHH in the MRA-1, numeral 122 denotes the band of the HHL in the MRA-1, numeral 123 denotes the band of the HMH in the MRA-1, numeral 124 denotes the band of the HML in the MRA-1, numeral 125 denotes the band of the HLH in the MRA-1, and numeral 126 denotes the band of the HLL in the MRA-1.

FIG. 14 will be described in detail. When the number of convexes and concaves per 1 mm is not greater than 20, all the data of convexes and concaves appear in the graph 126. When the number of convexes and concaves per 1 mm is 110, the data of convexes and concaves appear in the graph 124 most strongly, and appear in the HML 104 in FIG. 13(*b*). When the number of convexes and concaves per 1 mm is 220, the data of convexes and concaves appear in the graph 123 most strongly, and appear in the HMH 103 in FIG. 13(*b*). When the number of convexes and concaves per 1 mm is 310, the data of convexes and concaves appear in both the graphs 122 and 123, and appear in both the HHL 102 and HMH 103 in FIG. 13(*b*). Thus, depending on the frequency of the surface roughness, the data appears in any one or more of the six graphs. In other words, data of fine roughness appears on an upper graph in FIG. 13(*b*), and data of large roughness (swell) appears on a lower graph in FIG. 13(*b*).

As mentioned above, the surface roughness data is decomposed based on the frequency thereof, and the decomposed data is illustrated as graphs in FIG. 13(*b*). In each graph, the surface roughness is obtained to determine the surface roughness in the band. In this regard, the Arithmetical Mean Deviation of the Profile, the maximum height and the ten-point mean roughness can be determined as the surface roughness as illustrated in FIG. 13(*b*). In FIG. 13(*b*), the Arithmetical Mean Deviation of the Profile (WRa), the maximum height (WRmax) and the ten-point mean roughness (WRz) are illustrated in each graph. In this regard, since the properties are obtained as a result of wavelet transformation, W (wavelet transformation) is attached thereto as a prefix.

In this analysis, the measurement data obtained by the surface roughness and profile measuring instrument is separated into plural data based on the frequency. Therefore, change of convexes and concaves in each frequency band can be measured.

In addition, among the separated data illustrated in FIG. 13(*b*), the data of the minimum frequency component (HLL) is thinned.

The thinning rate (i.e., the number of extracted data) is determined by experiment. By properly setting the thinning rate, the frequency band separation can be properly performed in the multi-resolution analysis illustrated in FIG. 14. Namely, it becomes possible that the targeted frequency is included in the center of a band.

Figure 15:
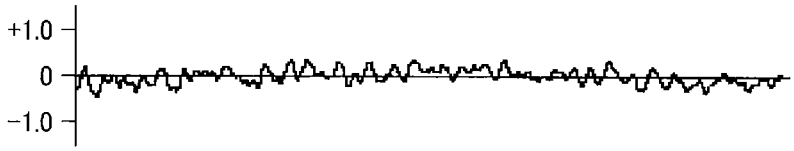
FIG. 15 is a graph illustrating minimum frequency data in the first multi-resolution analysis.

In FIG. 13, a thinning proceeding in which one data is extracted from 40 data was performed. The results of the thinning proceeding are shown in FIG. 15. In FIG. 15, the surface roughness (in units of μm) is plotted on the vertical axis, and the length is plotted on the horizontal axis. Although the scale is not illustrated, the measurement length is 12 mm.

The data illustrated in FIG. 15 is further subjected to a multi-resolution analysis, i.e., a second multi-resolution analysis MRA-2.

FIG. 13(*c*) illustrates six graphs obtained from the MRA-2.

In FIG. 13(*c*), an uppermost graph 107 illustrates the maximum frequency component LHH in the MRA-2. A graph 108 illustrates a frequency component LHL one rank lower than the LHH in the MRA-2. A graph 109 illustrates a frequency component LMH two ranks lower than the LHH in the MRA-2. A graph 110 illustrates a frequency component LML three ranks lower than the LHH in the MRA-2. A graph 111 illustrates a frequency component LLH four ranks lower than the LHH in the MRA-2. A graph 112 illustrates a minimum frequency component LLL in the MRA-2.

In this analysis, the data is separated into six graphs illustrated in FIG. 13(*c*) based on the frequency. This frequency separation is illustrated in FIG. 16.

Figure 16:
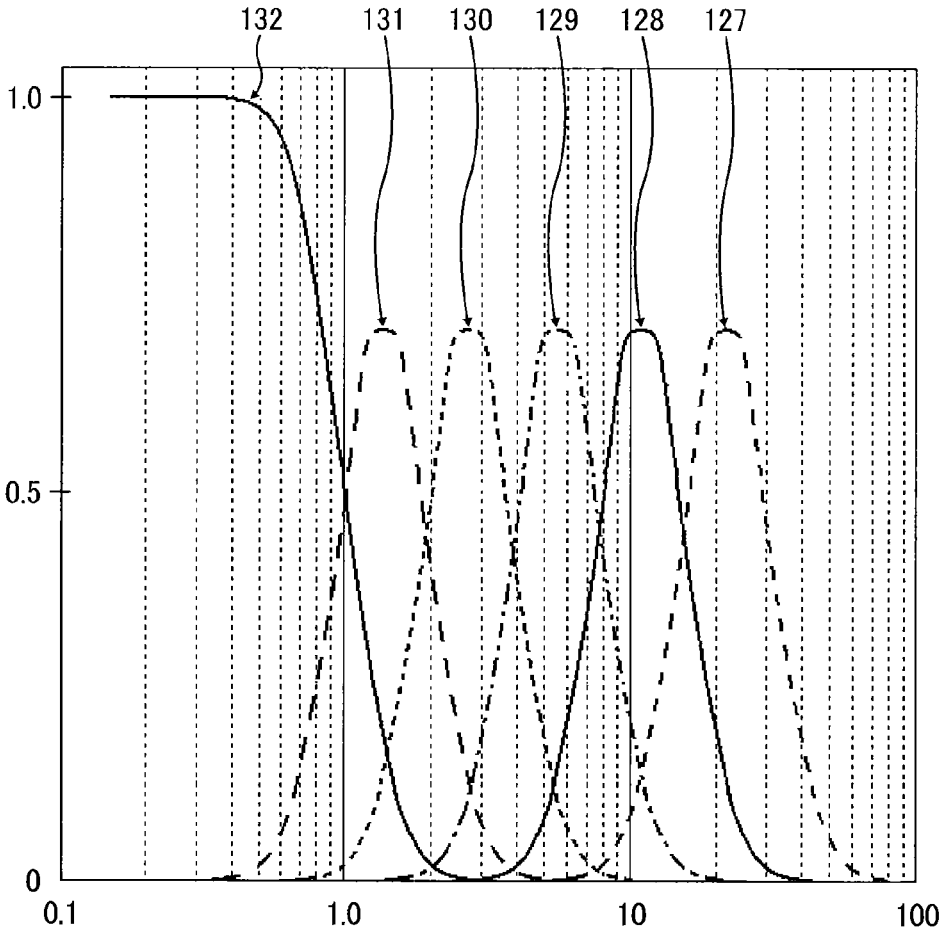
FIG. 16 illustrates frequency bands separated in the second multi-resolution analysis.

In FIG. 16, the number of convexes and concaves in a length of 1 mm is plotted on the horizontal axis, wherein it is assumed that the shape of the convexes and concaves is sine-wave. In addition, the proportion of each band is plotted on the vertical axis.

In FIG. 16, numeral 127 denotes the band of the LHH in the MRA-2, numeral 128 denotes the band of the LHL in the MRA-2, numeral 129 denotes the band of the LMH in the MRA-2, numeral 130 denotes the band of the LML in the MRA-2, numeral 131 denotes the band of the LLH in the MRA-2, and numeral 132 denotes the band of the LLL in the MRA-2.

FIG. 16 will be described in detail. When the number of convexes and concaves per 1 mm is not greater than 0.2, all the data of the convexes and concaves appear in the graph 132. When the number of convexes and concaves per 1 mm is 11, the graph 128 is the highest at the number. This means that the data of the convexes and concaves appear in the LLH band most strongly in FIG. 13(*c*). Thus, depending on the frequency of the surface roughness, the data appears in any one or more of the six graphs. In other words, data of fine roughness appears on an upper graph in FIG. 13(*c*), and data of large roughness (swell) appears on a lower graph in FIG. 13(*c*).

As mentioned above, the surface roughness data is decomposed based on the frequency thereof, and the decomposed data is illustrated as graphs in FIG. 13(*c*). In each graph, the surface roughness is obtained to determine the surface roughness in the band. In this regard, the Arithmetical Mean Deviation of the Profile (WRa), the maximum height (WRmax) and the ten-point mean roughness (WRz) can be determined as the surface roughness as illustrated in FIG. 13(*c*).

Thus, the one-dimensional data array obtained by measuring the roughness of surface of a photoreceptor using a surface roughness and profile measuring instrument is subjected to a multi-resolution analysis using the wavelet transformation to separate the data into plural frequency components of from a high frequency component to a low frequency component. In addition, the minimum frequency component is thinned to prepare a one-dimensional data array, and the one-dimensional data array is subjected to a second multi-resolution analysis using the wavelet transformation to separate the data into plural frequency components of from a high frequency component to a low frequency component. The Arithmetical Mean Deviation of the Profile (WRa), the maximum height (WRmax) and the ten-point mean roughness (WRz) of each frequency component are obtained. The results are shown in Table 1 below.

TABLE 1

| Multi-resolution analysis | Signal | Surface roughness determined from the multi-resolution analysis WRa (μm) | WRmax (μm) | WRz (μm) |
|---|---|---|---|---|
| First multi-resolution analysis (MRA-1) | HHH | 0.0045 | 0.0505 | 0.0050 |
| | HHL | 0.0027 | 0.0398 | 0.0025 |
| | HMH | 0.0023 | 0.0120 | 0.0102 |
| | HML | 0.0039 | 0.0330 | 0.0263 |
| | HLH | 0.0024 | 0.0758 | 0.0448 |
| | HLL | 0.1753 | 0.7985 | 0.6989 |
| Second multi-resolution analysis (MRA-2) | LHH | 0.0042 | 0.0665 | 0.0045 |
| | LHL | 0.0110 | 0.1637 | 0.0121 |
| | LMH | 0.0287 | 0.0764 | 0.0680 |
| | LML | 0.0620 | 0.3000 | 0.2653 |
| | LLH | 0.0462 | 0.2606 | 0.2131 |
| | LLL | 0.0888 | 0.3737 | 0.2619 |

By plotting the data of the Arithmetical Mean Deviation of the Profile (WRa) of the profile illustrated in FIG. 13 while connecting the data with a line, a curve (profile) illustrated in FIG. 17 is obtained. In this regard, since the WRa of the HLL is numerically prominent, the value is not plotted in FIG. 17. Since the HLL component is subjected to the MRA-2 and the components of from LHH to LLL are formed thereby, omission of the HLL causes no problem. In this application, the profile illustrated in FIG. 17 is referred to as a surface roughness spectrum or a roughness spectrum.

Figure 10:
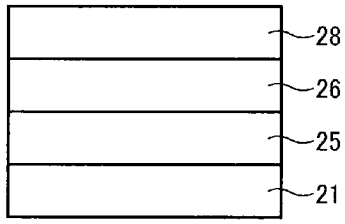
FIG. 10 is a schematic cross-sectional view illustrating a photoreceptor for use in the image forming apparatus.

Hereinafter, the photoreceptor of the image forming apparatus of this disclosure will be described by reference to FIGS. 10 and 11. FIG. 10 is a schematic cross-sectional view illustrating an example of the photoreceptor. The photoreceptor has a structure such that a charge generation layer 25, a charge transport layer 26, and a base outermost layer 28 are formed on an electroconductive support 21.

Figure 11:
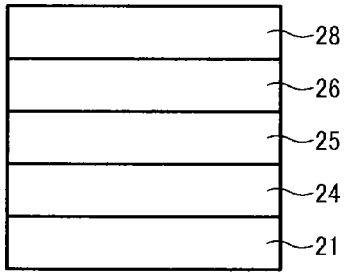
FIG. 11 is a schematic cross-sectional view illustrating another photoreceptor for use in the image forming apparatus.

FIG. 11 is a schematic cross-sectional view illustrating another example of the photoreceptor. The photoreceptor has a structure such that an undercoat layer 24, the charge generation layer 25, the charge transport layer 26, and the base outermost layer 28 are formed on the electroconductive support 21.

The electroconductive support 21 is not particularly limited as long as the support has a volume resistivity of not greater than $10^{10}$ Ω·cm. Specific examples of such materials include plastic cylinders, plastic films or paper sheets, on the surface of which a layer of a metal such as aluminum, nickel, chromium, nichrome, copper, gold, silver and platinum, or a layer of a metal oxide such as tin oxides and indium oxides, is formed by vapor deposition or sputtering. In addition, a plate of a metal such as aluminum, aluminum alloys, nickel and stainless steel can be used. Further, a metal cylinder, which is prepared by tubing a metal such as aluminum, aluminum alloys, nickel and stainless steel using a method such as drawing ironing, impact ironing, extruded ironing, extruded drawing and cutting, and then subjecting the surface of the tube to one or more treatments such as cutting, super finishing and polishing, can also be used as the support.

The photoreceptor can optionally include the undercoat layer 24 between the electroconductive support 21 and the photosensitive layer (i.e., the combination of the charge generation layer 25 and the charge transport layer 26). The undercoat layer 24 is formed to enhance the adhesion of the charge generation layer 25 to the electroconductive support 21, to prevent formation of moiré, to enhance the coating property of the upper layer (charge generation layer), and to prevent injection of charge from the electroconductive support 21.

The undercoat layer 24 includes a resin as a main component. In general, since a photosensitive layer is applied on the undercoat layer 24 using an organic solvent, the resin included in the undercoat layer is preferably a thermosetting resin, which is hardly dissolved in organic solvents. In particular, polyurethane, melamine resins, and alkyd-melamine resins are preferably used as the resin. The undercoat layer is typically prepared by applying a coating liquid, which is prepared by dissolving a resin in a solvent such as tetrahydrofuran, cyclohexanone, dioxane, dichloroethane and butanone, on the electroconductive support 21, followed by drying and optional crosslinking.

In order to prevent formation of moiré and to control the electroconductivity of the undercoat layer, a particulate metal or metal oxide can be included in the undercoat layer 24. Among these materials, titanium oxide is preferable. Such a particulate material is dispersed in a solvent such as tetrahydrofuran, cyclohexanone, dioxane, dichloroethane and butanone using a ball mill, an attritor, a sand mill or the like, and the dispersion is mixed with a resin component to prepare an undercoat layer coating liquid.

The undercoat layer 24 is typically prepared by applying such a coating liquid on the electroconductive support 21 by a coating method such as dip coating, spray coating, and bead coating, followed by drying and optional heating and crosslinking.

The thickness of the undercoat layer is generally from 2 μm to 5 μm. If the residual potential of the photoreceptor increases when the photoreceptor is repeatedly used, the thickness of the undercoat layer is preferably less than 3 μm.

The photosensitive layer of the photoreceptor is preferably a layered photosensitive layer in which a charge generation layer and a charge transport layer are overlaid. However, the photosensitive layer may be a single-layered photosensitive layer having both a charge generation function and a charge transport function.

The charge generation layer 25 of the layered photosensitive layer will be described.

The charge generation layer is located overlying the electroconductive support 21. In this regard, "overlying" can include direct contact and allow for intermediate layers. The charge generation layer is a part of the layered photosensitive layer and has a charge generation function such that when being irradiated, the layer generates a charge. The charge generation layer includes a charge generation material as a main component, and optionally includes a binder resin. Inorganic or organic charge generation materials can be used as the charge generation material.

Specific examples of the inorganic charge generation materials include crystalline selenium, amorphous selenium, selenium-tellurium compounds, selenium-tellurium-halogen compounds, selenium-arsenic compounds, and amorphous silicon. In addition, amorphous silicon in which a dangling bond is terminated with a hydrogen atom or a halogen atom or which is doped with a boron atom, or a phosphorous atom can be preferably used.

Specific examples of the organic charge generation materials include metal phthalocyanine pigments such as titanyl phthalocyanine and chlorogarium phthalocyanine; metal-free phthalocyanine; azulenium salt type pigments; squaric acid methyne pigments; symmetric or asymmetric azo pigments having a carbazole skeleton; symmetric or asymmetric azo pigments having a triphenylamine skeleton; symmetric or asymmetric azo pigments having a fluorenone skeleton; and perylene pigments. Among these materials, metal phthalocyanine pigments, symmetric or asymmetric azo pigments having a fluorenone skeleton, symmetric or asymmetric azo pigments having a triphenylamine skeleton, and perylene pigments are preferable because of having a good charge generation quantum efficiency.

These charge generation materials can be used alone or in combination.

Specific examples of the binder resin, which is optionally included in the charge generation layer, include polyamide, polyurethane, epoxy resins, polyketone, polycarbonate, polyarylate, silicone resins, acrylic resins, polyvinyl butyral resins, polyvinyl formal resins, polyvinyl ketone, polystyrene, poly-N-vinylcarbazole, polyacrylamide, etc. In addition, charge transport polymers mentioned below can also be used. Among these resins, polyvinyl butyral is preferable. These resins can be used alone or in combination.

The method for preparing the charge generation layer is broadly classified into vacuum thin film forming methods and casting methods using a solution or dispersion.

Specific examples of the vacuum thin film forming methods include vacuum deposition methods, glow discharge decomposition methods, ion plating methods, sputtering methods, reactive sputtering methods, chemical vapor deposition (CVD) methods, etc. By using these methods, a charge generation layer constituted of such an inorganic or organic charge generation material as mentioned above can be prepared.

When the charge generation layer is formed by a casting method, a coating liquid, which is typically prepared by dispersing one or more of the above-mentioned inorganic or organic charge generation materials optionally together with a binder resin in a solvent such as tetrahydrofuran, cyclohexanone, dioxane, dichloroethane and butanone (methyl ethyl ketone) using a ball mill, an attritor or a sand mill and which is properly diluted if desired, is applied on the electroconductive support 21 or the undercoat layer 24. Among the solvents, methyl ethyl ketone, tetrahydrofuran, and cyclohexanone are preferable because of being relatively environmentally-friendly compared with chlorobenzene, dichloromethane, toluene and xylene. Specific examples of the coating method include dip coating, spray coating, and bead coating.

The thickness of the charge generation layer is generally from 0.01 μm to 5 μm.

When it is desired to reduce the residual potential or to impart high photosensitivity, it is preferable to form a relatively thick charge generation layer. In this case, problems such that the charge maintainability deteriorates, and spatial charges are formed tend to be caused. In order to balance these properties, the thickness of the charge generation layer is preferably from 0.05 μm to 2 μm.

In addition, the charge generation layer can optionally include known additives such as low molecular compounds (e.g., antioxidants, plasticizers, lubricants, and ultraviolet absorbents), and leveling agent. These materials can be used alone or in combination. When such a low molecular compound and a leveling agent are used in combination, the photosensitivity of the photoreceptor tends to deteriorate. Therefore, the added amount of these material is generally from 0.1 to 20 phr (per hundred resin), and preferably from 0.1 to 10 phr, and the added amount of a leveling agent is from 0.01 to 0.1 phr.

The charge transport layer 26 has a charge transport function to inject and transport charges generated by the charge generation layer to neutralize the charges on the surface of the photoreceptor formed by a charger. The charge transport layer includes a charge transport material and a binder resin as main components.

Suitable materials for use as the charge transport material include low molecular weight electron transport materials, low molecular weight positive hole transport materials, and charge transport polymers.

Specific examples of the electron transport materials include asymmetric diphenoquinone derivatives, fluorenone derivatives, and naphthalimide derivatives. These electron transport materials can be used alone or in combination.

Electron donating materials are preferably used for the positive hole transport material. Specific examples thereof include oxazole derivatives, oxadiazole derivatives, imidazole derivatives, tripheylamine derivatives, butadiene derivatives, 9-(p-diethylaminostyrylanthracene), 1,1-bis(4-dibenzylaminophenyl)propane, styrylanthracene, styrylpyrazoline, phenyl hydrazone compounds, α-phenylstilbene derivatives, thiazole derivatives, triazole derivatives, phenazine derivatives, acridine derivatives, benzofuran derivatives, benzimidazole derivatives, and thiophene derivatives. These positive hole transport materials can be used alone or in combination.

Charge transport polymers can also be used as the charge transport material. For example, polymers having a carbazole ring such as poly-N-vinyl carbazole, polymers having a hydrozone structure disclosed in JP-S57-078402-A, polysilylene disclosed in JP-S63-285552-A, and aromatic polycarbonate such as polymers having formula (1) to (6) disclosed in JP-2001-330973-A. These charge transport polymers can be used alone or in combination. Among these polymers, polymers disclosed in JP-2001-330973-A are preferable because of having good electrostatic properties.

Charge transport polymers have an advantage such that when a base outermost layer is formed on a charge transport layer including a charge transport polymer, occurrence of a problem in that the components constituting the charge transport layer migrate into the base outermost layer, thereby causing defective crosslinking of the base outermost layer can be prevented relatively easily compared to a case where a low molecular weight charge transport material is used for the charge transport layer. In addition, since charge transport polymers have high heat resistance, occurrence of a problem in that when the base outermost layer is crosslinked, the charge transport layer is damaged by the crosslinking heat can be prevented.

Specific examples of resins for use as the binder resin of the charge transport layer include thermoplastic resins, and thermosetting resins such as polystyrene, polyester, polyarylate, polycarbonate, acrylic resins, silicone resins, fluorine-containing resins, epoxy resins, melamine resins, urethane resins, phenolic resins, and alkyd resins. Among these resins, polystyrene, polyester, polyarylate, and polycarbonate are preferable because of exhibiting good charge transportability when used in combination with a charge transport material.

Since the base outermost layer is formed on the charge transport layer 26, the charge transport layer is not required to have high mechanical strength unlike a charge transport layer serving as an outermost layer. Therefore, resins such as polystyrene, which are hardly used for conventional charge transport layers because the resins have good transparency but have slightly low mechanical strength, can be used for the charge transport layer 26.

These resins and charge transport polymers can be used alone or in combination. Alternatively, copolymers thereof can also be used. In addition, copolymers of such a resin and a charge transport material can also be used.

An electrically inactive polymer compound can be used to modify the charge transport layer. Specific examples thereof include cardo-polymer type polyester, which has a bulky skeleton such as fluorene; polyester such as polyethylene terephthalate and polyethylene naphthalate; polycarbonate such as C-form polycarbonate in which the 3 and 3' positions of the phenol component of a bisphenol type polycarbonate are substituted with an alkyl group; polycarbonate in which the geminal methyl group of bisphenol A is substituted with a long chain alkyl group having not less than 2 carbon atoms; polycarbonate having a biphenyl skeleton or a biphenylether skeleton; polycaprolactone; polycarbonate having a long chain alkyl skeleton such as polycaprolactone (disclosed in, for example, JP-H07-292095-A); acrylic resins; polystyrene; and hydrogenated polybutadiene.

In this regard, the electrically inactive polymer compound means a polymer compound which does not include a chemical structure having photoconductivity such as triarylamine structure. When such a resin is included as an additive in combination with the binder resin, the added amount is preferably not greater than 50% by weight based on the total weight of the solid components of the charge transport layer to maintain good light decaying property of the photoreceptor.

When a low molecular weight charge transport material is used, the added amount thereof is generally from 40 to 200 phr (per hundred resin), and preferably 70 to 100 phr. When a charge transport polymer is used, the charge transport polymer preferably has a formula such that resin components of from 0 to 200 parts by weight, and preferably from 80 to 150 parts by weight, are copolymerized with 100 parts by weight of resin components.

When two or more charge transport materials are included in the charge transport layer 26, difference in ionization potential therebetween is preferably as small as possible. Specifically, when the ionization potential difference is not greater than 0.10 eV, occurrence of a problem in that one charge transport material serves as a charge trap of another charge transport material can be prevented.

In addition, the ionization potential difference relationship (≤0.10 eV) is preferably established for a combination of a charge transport material and a crosslinked charge transport material mentioned below. In this regard, the ionization potential can be measured by a known method such as a method using an atmospheric ultraviolet photoelectron spectroscopic analyzer AC-1 from RIKEN KEIKI Co., Ltd.

In order to impart high photosensitivity to the photoreceptor, the content of a charge transport material in the charge transport layer is preferably not less than 70 phr. In addition, it is preferable to use a charge transport material such as monomers and dimmers of α-phenylstilbene compounds, benzidine compounds, and butadiene compounds, and charge transport polymers having a structure of these compounds in a main chain or a side chain because the charge transport material has a high charge mobility.

Specific examples of the solvent for use in preparing the charge transport layer coating liquid include ketones such as methyl ethyl ketone, acetone, methyl isobutyl ketone and cyclohexanone; ethers such as dioxane, tetrahydrofuran, and ethyl cellosolve; aromatic hydrocarbons such as toluene and xylene; halogen-containing solvents such as chlorobenzene and dichloromethane; and esters such as ethyl acetate and butyl acetate. Among these solvents, methyl ethyl ketone, tetrahydrofuran, and cyclohexanone are preferable because of being relatively environmentally-friendly compared with chlorobenzene, dichloromethane, toluene and xylene. These solvents can be used alone or in combination.

The charge transport layer 26 is typically prepared by applying a coating liquid, which is prepared by dissolving or dispersing at least a mixture or a copolymer of a charge transport component and a binder resin component in a solvent, on the charge generation layer 25, followed by drying. Specific examples of the coating method include dip coating, spray coating, ring coating, roll coating, gravure coating, nozzle coating and screen printing.

Since the base outermost layer is formed on the charge transport layer, it is not necessary to determine the thickness of the charge transport layer in consideration of abrasion loss of the charge transport layer. Therefore, the thickness is generally from 10 μm to 40 μm, and preferably from 15 μm to 30 μm, to impart a good combination of photosensitivity and charging property to the photoreceptor.

If desired, additives such as low molecular compounds such as antioxidants, plasticizers, lubricants and ultraviolet absorbents, and leveling agents can be added to the charge transport layer. These materials can be used alone or in combination. When such a low molecular compound and a leveling agent are used in combination, the photosensitivity of the photoreceptor tends to deteriorate. Therefore, the added amount of these material is generally from 0.1 to 20 phr (per hundred resin), and preferably from 0.1 to 10 phr, and the added amount of a leveling agent is from 0.01 to 0.1 phr.

Next, the base outermost layer 28 will be described. The base outermost layer is a protective layer formed on the surface of the photoreceptor. This protective layer is typically prepared by coating a coating liquid including a resin (monomer) component, and then subjecting the coated resin component to a polycondensation reaction or an addition polymerization reaction to prepare a crosslinked resin layer. Since the layer includes a crosslinked resin, the layer is toughest (i.e., the layer has the highest abrasion resistance) among the layers of the photoreceptor. In addition, since the layer includes a charge transport structure, the layer has almost the same charge transportability as that of the charge transport layer.

The surface of the photoreceptor (i.e., the surface of the base outermost layer) preferably has a roughness spectrum such that the WRa(LLH) is less than 0.04 μm, and the WRa (HLH) is less than 0.005 μm. Therefore, the surface of the photoreceptor is roughened by a specific method. Specific examples of the roughening method include a method in which an agent (such as filler) to roughen the surface while controlling the roughness is added to the base outermost layer; a method using a sol-gel type coating liquid; a method using a coating liquid including a mixture of polymers having different glass transition temperatures; a method using a coating liquid including a particulate organic material; a method using a coating liquid including a foaming agent; and a method using a coating liquid including a silicone oil in a large amount. In addition, a method in which the layer forming conditions are controlled can also be used for roughening the surface of the photoreceptor. Specific examples of the method include a method using a coating liquid including a large amount of water; a method using a coating liquid including solvents having different boiling points. Further, a method in which an organic solvent or water is sprayed on an applied coating liquid (i.e., a wet film which is not yet crosslinked) can also be used. Furthermore, a method in which the crosslinked base outermost layer is subjected to sandblasting or a rubbing treatment to rub the surface of the base outermost layer with an abrasive paper can also be used. Among these methods, the method, which forms the base outermost layer using a coating liquid including a filler and which controls the surface roughness while controlling the degree of aggregation of the filler, is preferable because the method has a high degree of flexibility in controlling the surface roughness.

The degree of aggregation of a filler changes depending on the properties of the dispersant used in combination with the filler, such as the number of functional groups of the dispersant, the amount of branched portions of the dispersant, the molecular weight of the dispersant, and the molecular structure of the dispersant. In addition, degree of aggregation of a filler changes depending on the added amount of a dispersant, and the dispersing time. Therefore, it is preferable to form the base outermost layer having a desired surface roughness by properly adjusting these factors.

The crosslinked resin type outermost layer can be prepared by crosslinking a binder resin component including a tri- or more-functional radically polymerizable monomer having no charge transport structure. The thus prepared crosslinked resin type outermost layer can impart a good combination of photosensitivity and durability to the photoreceptor while satisfactorily performing the above-mentioned recycling of the circulating outermost layer.

Caprolactone-modified dipentaerythritol hexaacrylate or dipentaerythritol hexaacrylate is preferably used as the tri- or more-functional radically polymerizable monomer. In this case, the abrasion resistance and/or the toughness of the crosslinked layer can be enhanced.

Suitable materials for use as the tri- or more-functional radically polymerizable monomer having no charge transport structure include trimethylolpropane triacrylate, caprolactone-modified dipentaerythritol hexaacrylate, or dipentaerythritol hexaacrylate.

These are commercially available (such as reagents from Tokyo Kasei Kogyo Co., Ltd., KAYARAD DPCA series and KAYARAD DPHA series from Nippon Kayaku Co., Ltd.).

In order to accelerate and stabilize the crosslinking reaction, an initiator such as IRGACURE 184 from Ciba Specialty Chemicals Inc. (BASF) can be used in an amount of from 5 to 10% by weight based on the total weight of the solid components.

Specific examples of a crosslinkable charge transport material include chain-polymerizable compounds including an acryloyloxy group or a styrene group, sequentially-polymerizable compounds having a hydroxyl group, an alkoxysilyl group or an isocyanate group, and compounds having a charge transport structure and at least one (meth)acryloyloxy group. These can be used alone or in combination. In addition, it is possible to use one or more of these compounds in combination with a monomer or oligomer having at least one (meth)acryloyloxy group and no charge transport structure. The base outermost layer can be prepared, for example, by coating a coating liquid including such a crosslinkable charge transport material to form an outermost layer, and then applying energy such as heat, light, or radiation (e.g., electron beams and γ rays) to the layer to crosslink the layer. Specific examples of the crosslinkable charge transport material include compounds having the following formula (1).

(1)

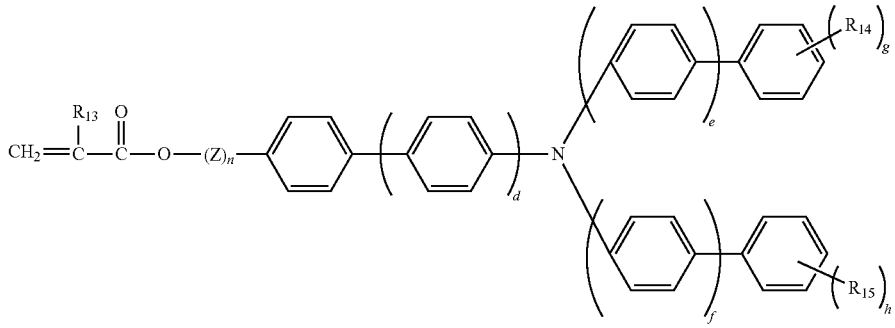

In formula (1), each of d, e and f is 0 or 1; each of g and h is 0 or an integer of from 1 to 3; n is 0 or 1; $R_{13}$ represents a hydrogen atom or a methyl group; each of $R_{14}$ and $R_{15}$ represents an alkyl group having 1 to 6 carbon atoms, wherein when g or h is 2 or 3, the plural $R_{14}$ or $R_{15}$ groups may be the same or different from each other; Z represents a methylene group, an ethylene group, or a divalent group having one of the following formulae (2) to (4).

(2)

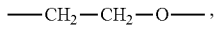

(3)

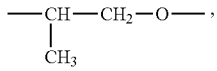

and (4)

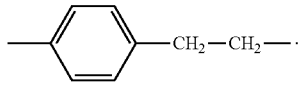

Specific examples of the compounds having formula (1) include the following compounds No. 1 to No. 26.

No. 1

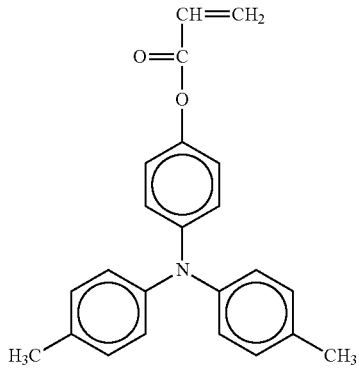

-continued

No. 2

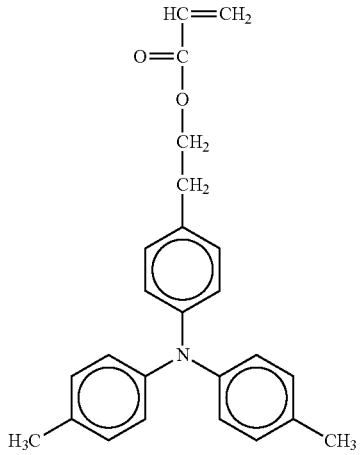

No. 3

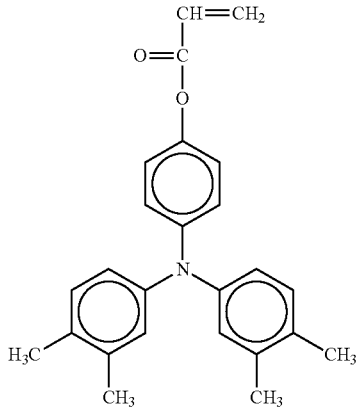

-continued
No. 4
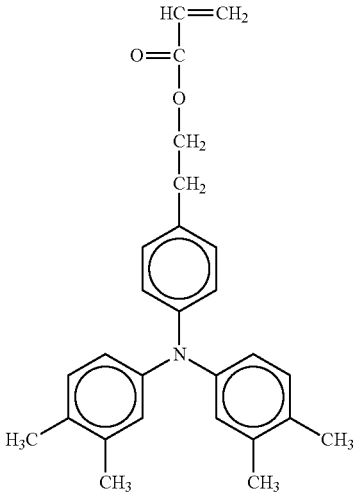
No. 5
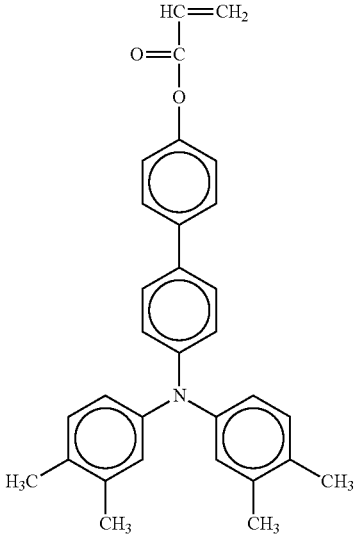
No. 6
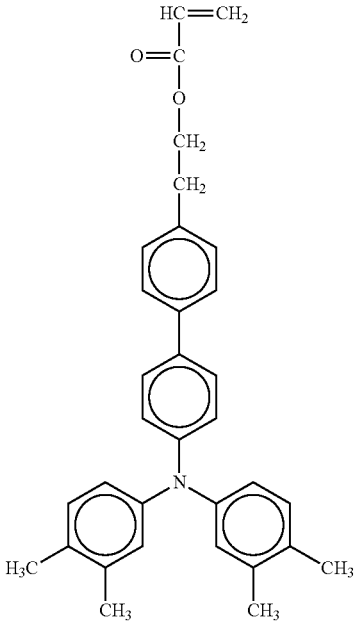
-continued
No. 7
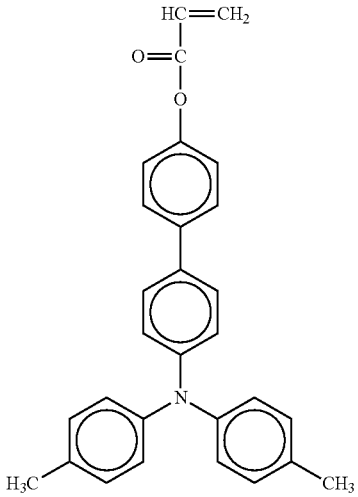
No. 8
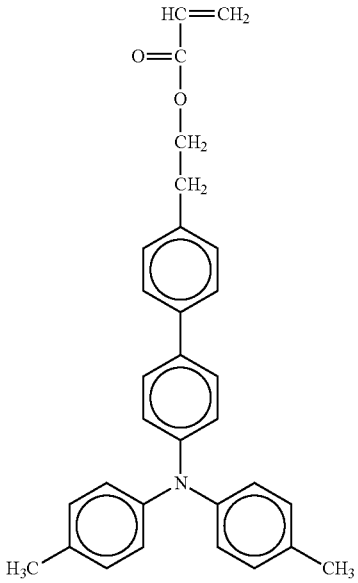

-continued
No. 9
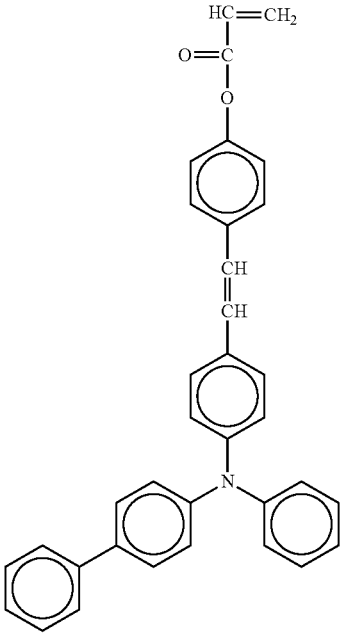
-continued
No. 11
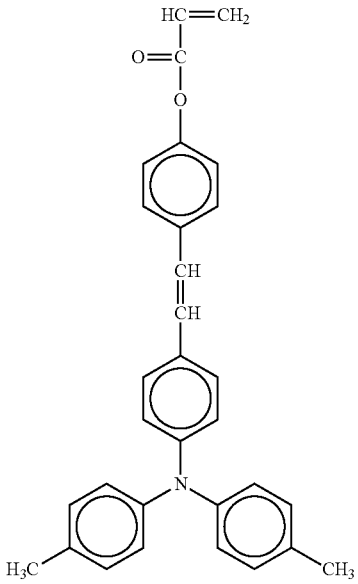
No. 10
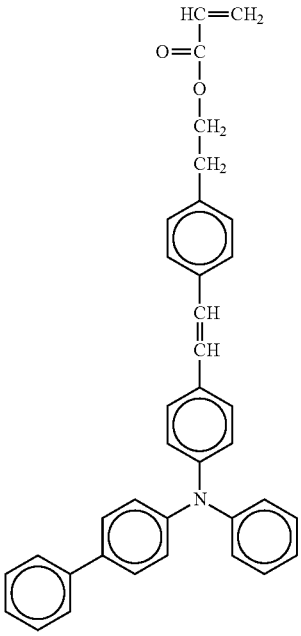
No. 12
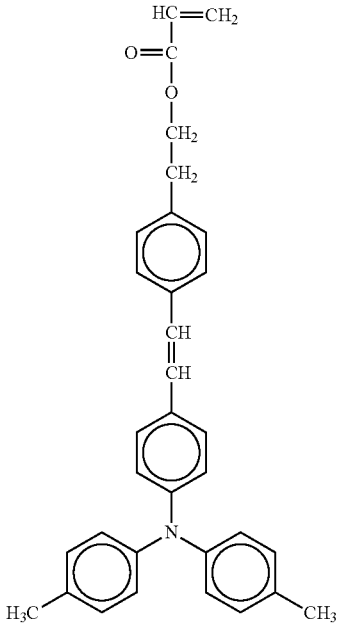

-continued
No. 13
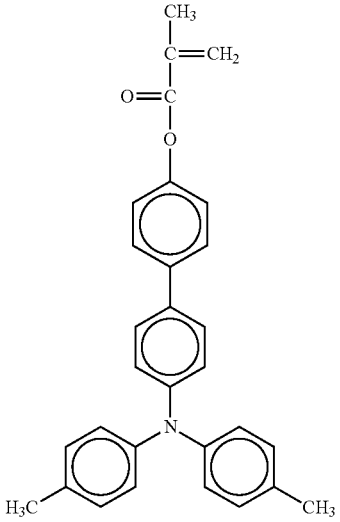
No. 14
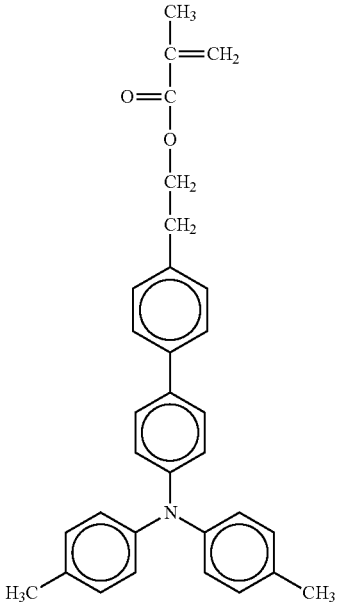
No. 15
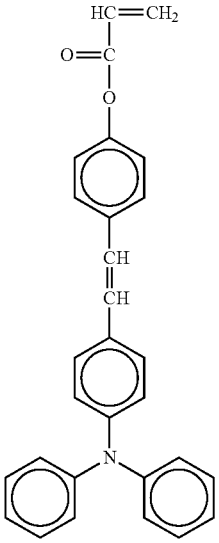
-continued
No. 16
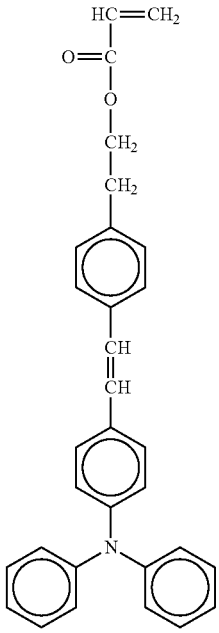
No. 17
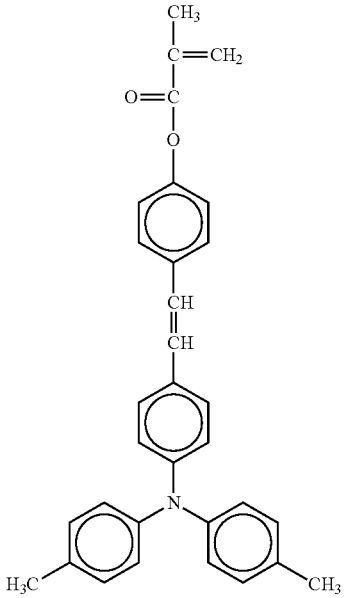

-continued
No. 18
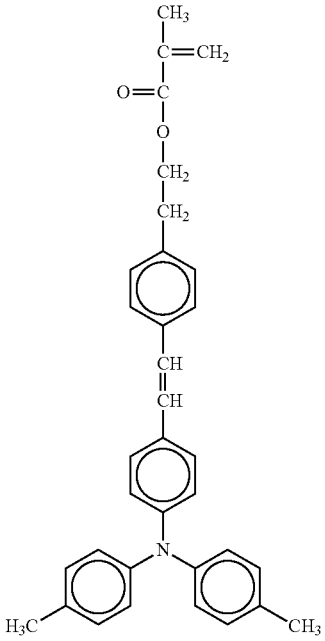
No. 19
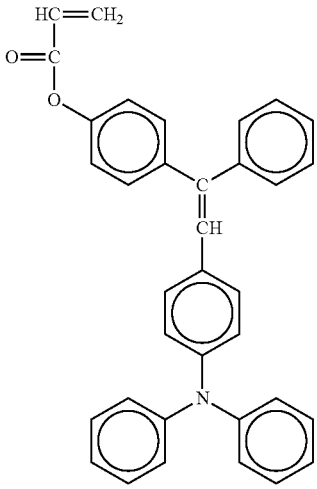
-continued
No. 20
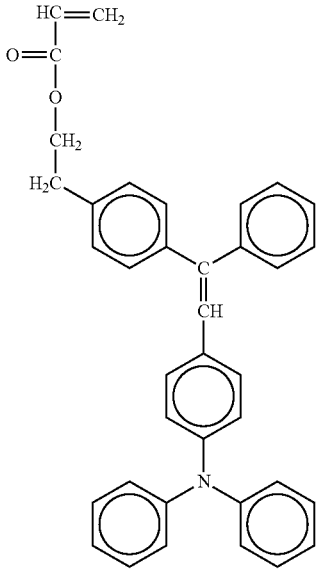
No. 21
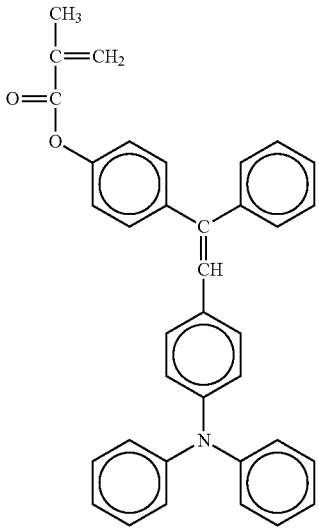

-continued
No. 22
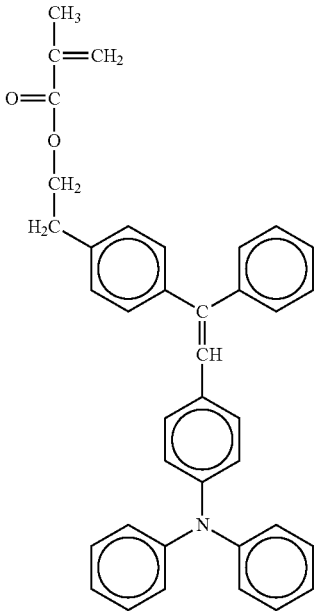
No. 23
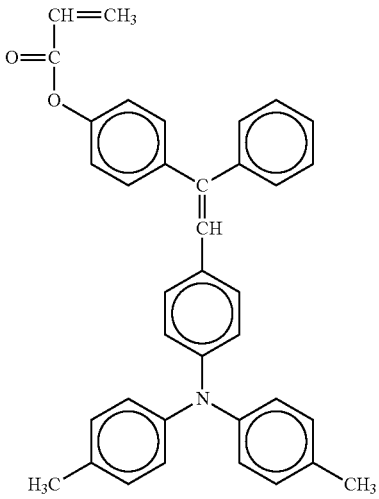
-continued
No. 24
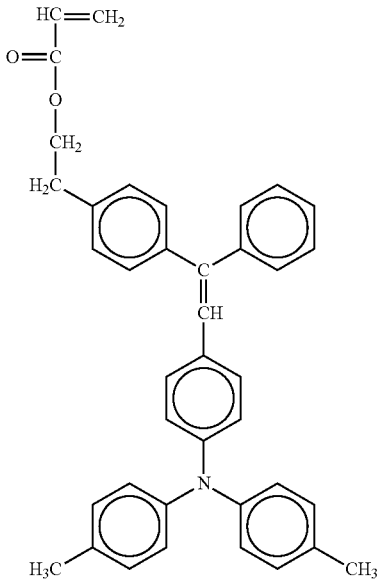
No. 25
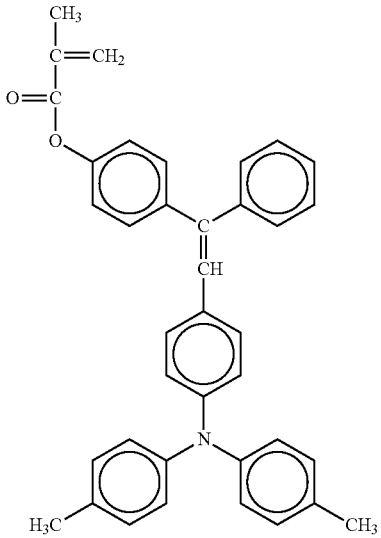

-continued

No. 26

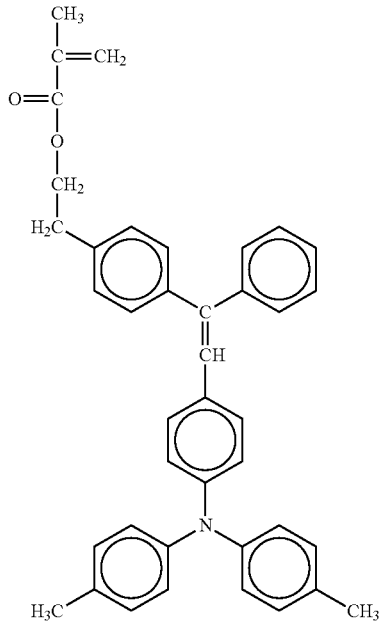

The base outermost layer can include a filler having a high hardness to enhance the abrasion resistance thereof. Specific examples thereof include silica, alumina and cerium oxide. Among these fillers, α-alumina having a hexagonal close-packed structure, which is prepared by a gas phase polymerization method, is preferable because of imparting a high surface hardness to the photoreceptor at relatively low costs. This filler has substantially a spherical form and therefore does not form a spine on the surface of the photoreceptor. Therefore, the contact members rubbing the surface of the photoreceptor are hardly damaged. The content of such a filler is generally from 1 to 30% by weight based on the total weight of the solid components included in the base outermost layer.

When a filler is included in the base outermost layer, the residual potential (i.e., the potential of an irradiated portion) of the photoreceptor often increases. In such a case, it is effective to include tin oxide in the base outermost layer. Since tin oxide has lower hardness than α-alumina, the mechanical strength of the base outermost layer tends to decrease as the amount of α-alumina replaced with tin oxide increases. Therefore, the added amount of tin oxide is preferably from 5 to 50% by weight based on the total weight of the high hardness filler included in the base outermost layer to impart a good combination of mechanical strength and residual potential property to the photoreceptor. In addition, by adding an organic acid such as citric acid and maleic acid to the base outermost layer, residual potential of the photoreceptor can be reduced.

The dispersing solvent used for preparing the base outermost layer coating liquid preferably dissolves well monomers used for forming the base outermost layer. For example, ethers, aromatic hydrocarbons, halogen-including solvents, and esters mentioned above can be used. In addition, cellosolves such as ethoxy ethanol, and propylene glycol compounds such as 1-methoxy-2-propanol can also be used. Among these solvents, methyl ethyl ketone, tetrahydrofuran, cyclohexanone and 1-methoxy-2-propanol are preferable because of being relatively environmentally-friendly compared with chlorobenzene, dichloromethane, toluene and xylene. These solvents can be used alone or in combination.

Specific examples of the coating method for forming the base outermost layer include dip coating, spray coating, ring coating, roll coating, gravure coating, nozzle coating and screen printing. Since the pot life of the coating liquid is not long, it is preferable to use a coating method which can perform coating using a relatively small amount of coating liquid so that the coating is environmentally friendly and has low costs. From this point of view, spray coating and ring coating are preferable. In addition, inkjet coating methods can also be used for forming a base outermost layer having the above-mentioned surface roughness.

When forming the film of the base outermost layer, UV light sources such as high pressure mercury lamps, and metal halide lamps, which can emit light including ultraviolet light, can be used. In addition, it is possible to use a light source emitting visible light which has a wavelength corresponding to the absorption wavelength of the radically polymerizable compound and light polymerization initiator. The amount of light used for irradiating the applied base outermost layer coating liquid is preferably from 50 to 100 $mW/cm^2$. When the light amount is less than 50 $mW/cm^2$, it takes time to crosslink the base outermost layer. In contrast, when the light amount is greater than 100 $mW/cm^2$, the crosslinking reaction rends to be unevenly performed, thereby causing problems such that the crosslinked base outermost layer is wrinkled partially, and a large amount of non-reacted groups or non-reacted terminals remains in the base outermost layer. In addition, since the internal stress of the base outermost layer seriously increases due to rapid crosslinking of the layer, problems such that the base outermost layer is cracked, and the layer is released from the lower layer are often caused.

The base outermost layer can optionally include known additives such as low molecular compounds (e.g., antioxidants, plasticizers, lubricants, and ultraviolet absorbents), and leveling agent. These materials can be used alone or in combination. When such a low molecular compound and a leveling agent are used in combination, the photosensitivity of the photoreceptor tends to deteriorate. Therefore, the added amount of these materials is generally from 0.1 to 20% by weight, and preferably from 0.1 to 10% by weight, and the added amount of a leveling agent is preferably from 0.1 to 5% by weight, based on the total weight of the solid components included in the base outermost layer.

The thickness of the base outermost layer is preferably from 3 μm to 15 μm. The lower limit is determined from the cost performance, and the upper limit is determined from the viewpoints of electrostatic properties (such as charge stability and photosensitivity) of the photoreceptor and evenness of the layer.

Next, the image forming apparatus of this disclosure will be described by reference to drawings. The image forming apparatus includes a circulating agent applicator, which is described later.

FIG. 1 is a schematic view illustrating an example of the image forming apparatus of this disclosure. The below-mentioned modified versions of the image forming apparatus can be included in this disclosure. Referring to FIG. 1, the photoreceptor 11 is a photoreceptor having the base outermost layer mentioned above. The photoreceptor has a drum shape, but a sheet-shaped or endless belt-shaped photoreceptor can also be used.

The charger 12 charges evenly the surface of the photoreceptor 11, and a charger such as corotron, scorotron, solid state chargers, and charging rollers can be used. In this regard, a contact or short-range charger is preferably used to reduce electric power consumption. Among these chargers, a short-range charger such that a proper gap is formed between the surface of the photoreceptor and the surface of a charging member is more preferable because of having an advantage such that the charging member is hardly contaminated with residual toner on the surface of the photoreceptor. A charger (such as those mentioned above) can be used for the transferring device 16, and a combination of a transfer charger and a separation charger is preferably used.

An irradiator 13 and a discharging device 1A (which is described in another example illustrated in FIG. 2, etc.) have a light source to irradiate the charged photoreceptor 11 with light. Suitable light sources for use in the irradiator 13 and the discharging device 1A include fluorescent lamps, tungsten lamps, halogen lamps, mercury lamps, sodium lamps, light emitting diodes (LEDs), laser diodes (LDs), light sources using electroluminescence (EL), etc. In addition, in order to obtain light in a desired wave length range, filters such as sharp-cut filters, band pass filters, near-infrared cutting filters, dichroic filters, interference filters, color temperature converting filters, etc. can be used.

An image of a toner 15 is formed on the photoreceptor 11 by the developing device 14, and the toner image on the photoreceptor is transferred onto a recording medium 18. In this regard, all the toner of the image is not transferred to the recording medium, and part of the toner image remains on the surface of the photoreceptor 11. The residual toner is removed from the surface of the photoreceptor 11 by the cleaner 17. A rubber cleaning blade, or a brush such as a fur brush and a mag-fur brush can be used for the cleaner 17.

When the photoreceptor 11 is charged positively (or negatively) by the charger 12, and is then exposed to light emitted by the irradiator 13 and including image information, an electrostatic latent image having a positive (or negative) charge is formed on the photoreceptor 11. When the latent image having a positive (or negative) charge is developed by the developing device 14 using a toner having a negative (or positive) charge, a positive image can be obtained. In contrast, when the latent image having a positive (negative) charge is developed with a toner having a positive (negative) charge, a negative image (i.e., a reversal image) can be obtained. Known developing methods can be used for the developing device 14, and known discharging methods can be used for the discharging device 1A. The recording medium 18, on which the toner image 15 is transferred from the photoreceptor 11 by the transfer device 16, is fed to a fixing device 19 so that the toner image is fixed to the recording medium.

As illustrated in FIG. 1, the circulating agent 3A, and the application blade 3C to apply the circulating agent are arranged between the cleaner 17 and the charger 12. Namely, the circulating agent 3A and the application blade 3C to apply the circulating agent are arranged on a downstream side from the cleaner 17 and on an upstream side from the charger 12 relative to the moving direction of the photoreceptor 11. This positional relationship is also applied to the other examples of the image forming apparatus mentioned below.

Figure 2:
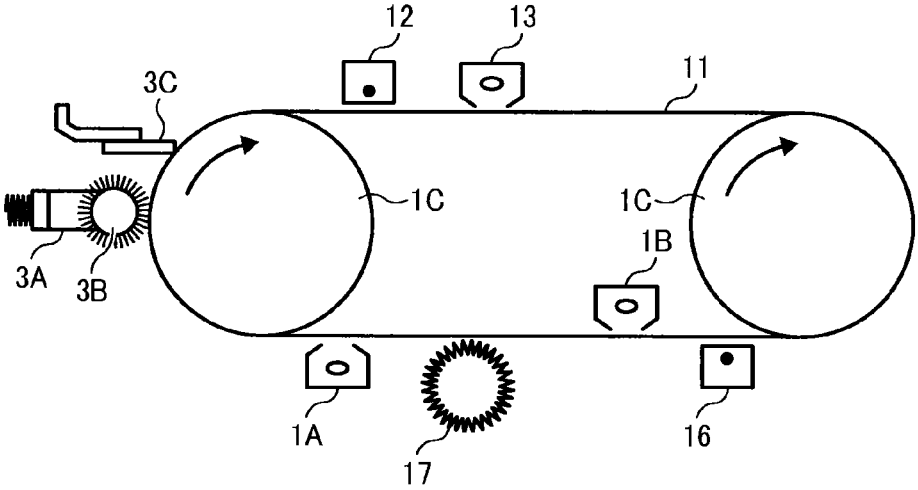
FIG. 2 is a schematic cross-sectional view illustrating another image forming apparatus according to an embodiment.

FIG. 2 illustrates another example of the image forming apparatus of this disclosure. Referring to FIG. 2, the photoreceptor 11 is a photoreceptor having the base outermost layer mentioned above. The photoreceptor has an endless belt shape, but a sheet-shaped or drum-shaped photoreceptor can also be used. The photoreceptor 11 is driven by a driving device 1C, and is repeatedly subjected to charging using the charger 12, image irradiation using the irradiator 13, development (the developing device is not shown in FIG. 2), transferring using the transferring device 16, pre-cleaning irradiation using a pre-cleaning irradiator 1B, cleaning using the cleaner 17, and discharging using the discharging device 1A. The circulating agent 3A and the application blade 3C to apply the circulating agent are arranged on a downstream side from the cleaner 17 and on an upstream side from the charger 12 relative to the moving direction of the photoreceptor 11. In the image forming apparatus illustrated in FIG. 2, the support of the photoreceptor 11 is transparent, and therefore the pre-cleaning irradiation is performed from the backside (from the support side) of the photoreceptor.

The electrophotographic image forming process is not limited to the process of the image forming apparatus illustrated in FIG. 2. For example, although the pre-cleaning irradiation is performed from the backside, the pre-cleaning irradiation can be performed from the front side (i.e., from the photosensitive layer side). In addition, the image irradiation and the discharge light irradiation can be performed from the backside of the photoreceptor. Although the image irradiation, the pre-cleaning irradiation, and the discharge light irradiation are performed in the image forming apparatus illustrated in FIG. 2, other light irradiation processes such as pre-transfer irradiation, and pre-irradiation of the image irradiation can also be performed on the photoreceptor 11.

Figure 3:
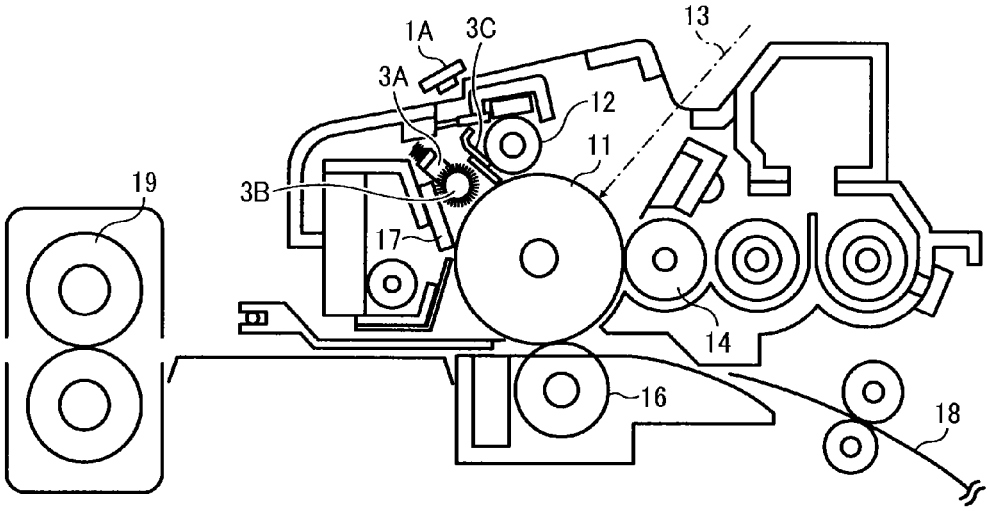
FIG. 3 is a schematic cross-sectional view illustrating another image forming apparatus according to an embodiment.

The above-mentioned image forming devices may be fixedly set to the image forming apparatus (such as copiers, facsimiles and printers), but can be set to the image forming apparatus as a unit (i.e., a process cartridge). Various process cartridges can be used, and an example of the process cartridge is illustrated in FIG. 3. In this process cartridge, the photoreceptor 11, the charger 12, the developing device 14, the cleaner 17, the circulating agent applicator, which includes the circulating agent 3A, the application brush 3B, and the application blade 3C, and the discharging device 1A are unitized.

A toner image formed on the surface of the photoreceptor 11 of the process cartridge is transferred onto the recording medium 18 by the transferring device 16, and the recording medium bearing the toner image thereof is fed to the fixing device 19 so that the toner image is fixed to the recording medium.

Figure 4:
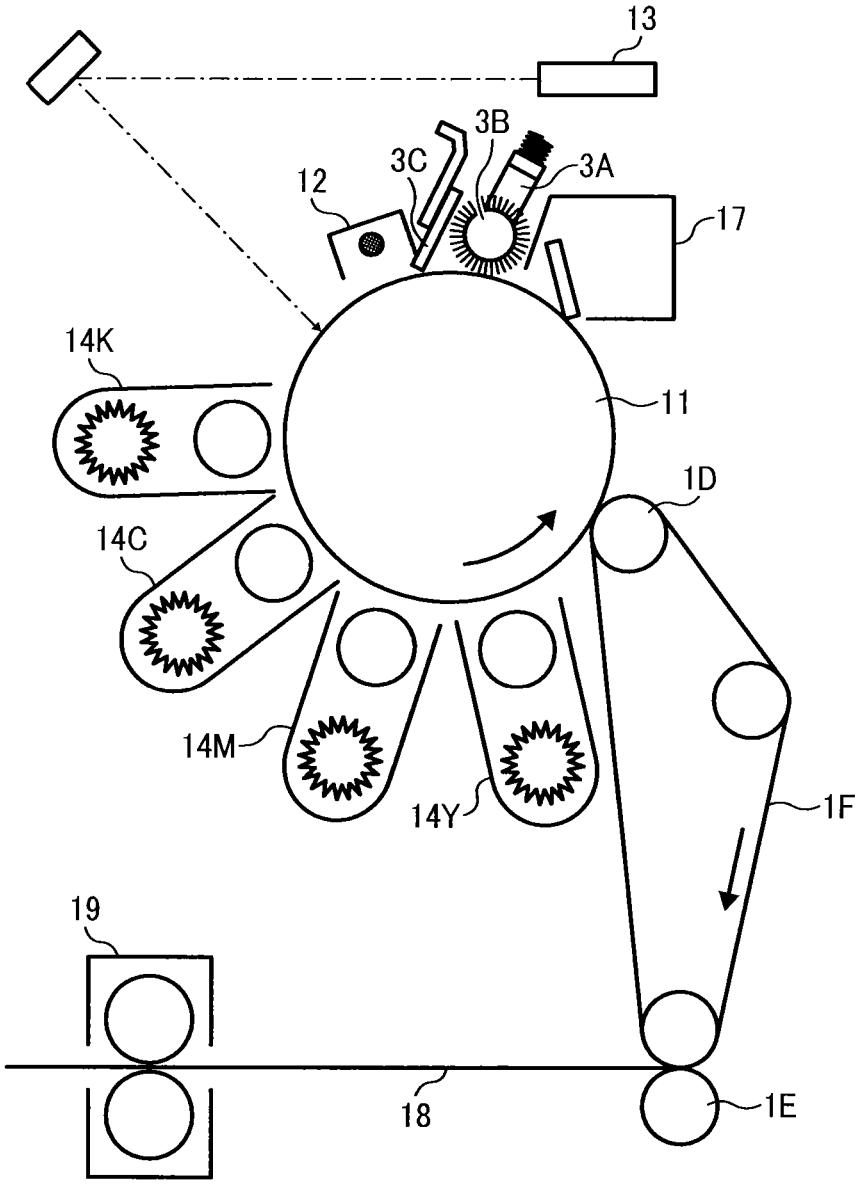
FIG. 4 is a schematic cross-sectional view illustrating another image forming apparatus according to an embodiment.

FIG. 4 illustrates another example of the image forming apparatus of this disclosure. In this image forming apparatus, the charger 12, the irradiator 13, the developing device 14, which includes a black developing device 14K, a cyan developing device 14C, a magenta developing device 14M, and a yellow developing device 14Y, an intermediate transfer belt 1F serving as an intermediate transfer medium, and the cleaner 17 are arranged around the photoreceptor 11. In this regard, the suffixes K, C, M and Y denote the colors (i.e., black, cyan, magenta and yellow) of the toners used for developing. The suffixes are sometimes omitted if they are not necessary for description. The photoreceptor 11 is a photoreceptor including the base outermost layer mentioned above. The developing devices 14K, 14C, 14M and 14Y are independently controlled, and one or more of the developing devices, which are directed to form a toner image of the color, are driven. The toner images formed on the photoreceptor 11 are transferred to the intermediate transfer belt 1F by a primary transferring device 1D arranged inside the intermediate transfer belt. The primary transferring device 1D is detachably attachable to the intermediate transfer belt 1F, and when a toner image is transferred, the primary transferring device attaches the intermediate transfer belt 1F to the photoreceptor 11. The K, C, M and Y color toner images formed on the photoreceptor by the developing devices 14K, 14C, 14M and 14Y are transferred onto the intermediate transfer belt 1F so as to be overlaid to form a combined color toner image, and the combined color toner image is transferred to the recording medium 18 by a secondary transferring device 1E. The recording medium 18 bearing the combined color toner image is fed to the fixing device 19 so that the color toner image is fixed to the recording medium, thereby forming a full color image. The secondary transferring device 1E is also detachably attachable to the intermediate transfer belt 1F, and when a toner image is secondarily transferred, the secondary transferring device is attached to the intermediate transfer belt 1F.

In an image forming apparatus using a transfer drum, color toner images are sequentially transferred onto a recording medium which is electrostatically attracted by the transfer drum. Therefore, it is difficult to transfer toner images onto a thick recording medium. However, since toner images are transferred onto the intermediate transfer belt 1F in the image forming apparatus illustrate in FIG. 4, the toner images can be satisfactorily transferred even on a thick recording medium. Such an intermediate transfer method can also be used for the image forming apparatuses illustrate in FIGS. 1, 2, 3 and 5.

In the image forming apparatus illustrated in FIG. 4, the circulating agent 3A and the application blade 3C to apply the circulating agent are arranged on a downstream side from the cleaner 17 and on an upstream side from the charger 12 relative to the moving direction of the photoreceptor 11.

Figure 5:
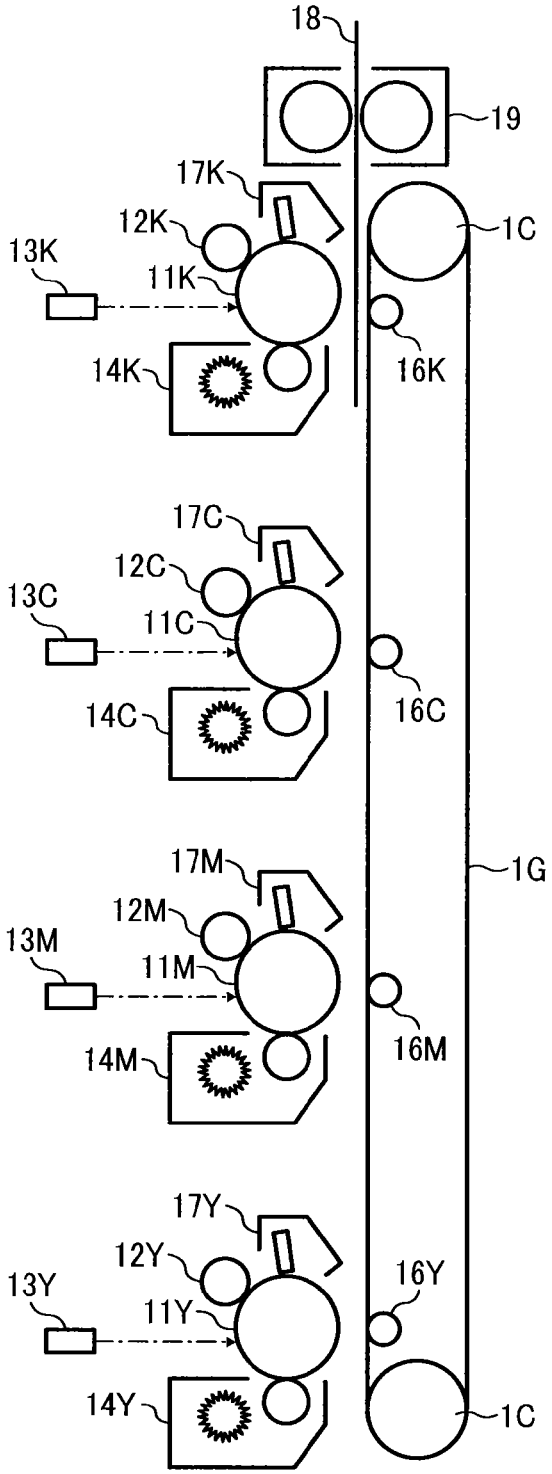
FIG. 5 is a schematic cross-sectional view illustrating another image forming apparatus according to an embodiment.

FIG. 5 illustrates another example of the image forming apparatus of this disclosure. This image forming apparatus includes four color image forming sections for forming yellow (Y), magenta (M), cyan (C) and black (K) color toner images. The image forming sections include respective photoreceptors 11Y, 11M, 11C and 11K, each of which includes the above-mentioned base outermost layer. In each image forming section, a charger 12Y, 12M, 12C or 12K, an irradiator 13Y, 13M, 13C or 13K, a developing device 14Y, 14M, 14C or 14K, a cleaner 17Y, 17M, 17*c* or 17K, etc., are arranged around the photoreceptor 11Y, 11M, 11C or 11K. In addition, a feeding and transferring belt 1G, which is looped over the driving device 1C so as to be rotated thereby, is detachably attached to the image transfer positions of the photoreceptors 11, which are arranged side by side in a line. Transferring devices 16Y, 16M, 16C and 16K are arranged inside the feeding and transferring belt 1G so as to be opposed to the photoreceptors at the transfer positions. In each image forming section, both the circulating agent and the circulating agent application blade (which are not illustrated in FIG. 5) are arranged on a downstream side from the cleaner 17 and on an upstream side from the charger 12 relative to the moving direction of the photoreceptor 11.

In the tandem image forming apparatus illustrated in FIG. 5, color toner images formed on the photoreceptors 11 are sequentially transferred to the recording medium 18 fed by the feeding and transferring belt 1G, and therefore, full color images can be produced at a higher speed than that in a full color image forming apparatus having only one photoreceptor. The recording medium 18 bearing the color toner images thereon is fed to the fixing device 19 by the feeding and transferring belt 1G so that the toner image is fixed on the recording medium.

Figure 6:
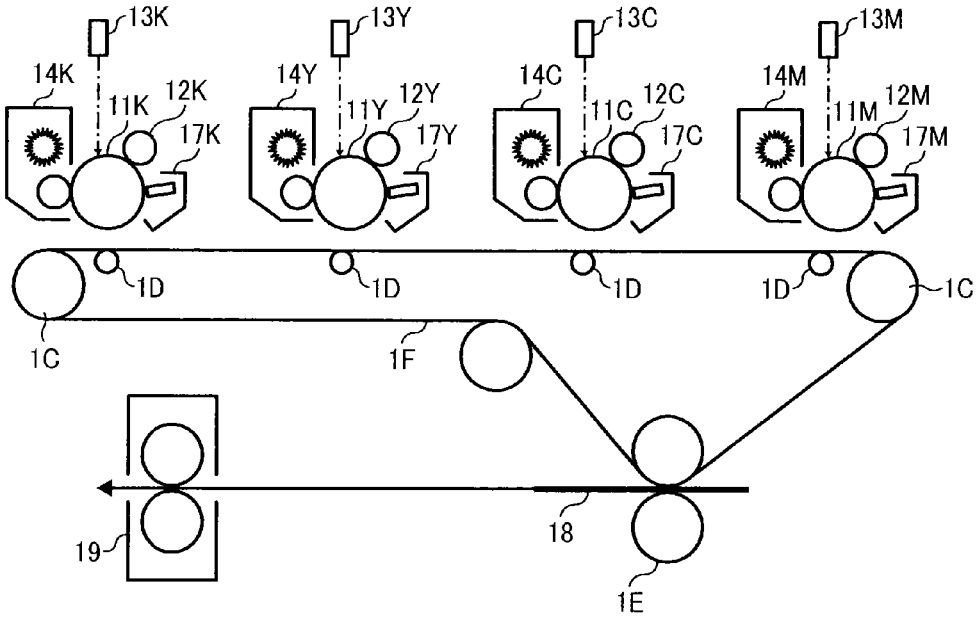
FIG. 6 is a schematic cross-sectional view illustrating another image forming apparatus according to an embodiment.

The image forming apparatus of this disclosure is not limited to the structure (i.e., a direct transferring method) illustrated in FIG. 5, and can have such a structure as illustrated in FIG. 6. Specifically, in the image forming apparatus illustrated in FIG. 6, the intermediate transfer belt 1F is used instead of the feeding and transferring belt 1G.

In the image forming apparatus illustrated in FIG. 6, color toner images formed on the photoreceptors 11Y, 11M, 11C and 11K are sequentially transferred onto the intermediate transfer belt 1F, which is rotated by the rollers 1C serving as a driving device while tightly stretched thereby, to form a combined color toner image. The combined color toner image is fed by the intermediate transfer belt 1F and is secondarily transferred onto the recording medium 18 at the secondary transfer position in which the intermediate transfer belt is opposed to the secondary transferring device 1E. The recording medium 18 bearing the combined color toner image thereon is fed to the fixing device 19 so that the color toner image is fixed to the recording medium, resulting in formation of a full color image.

Figure 9:
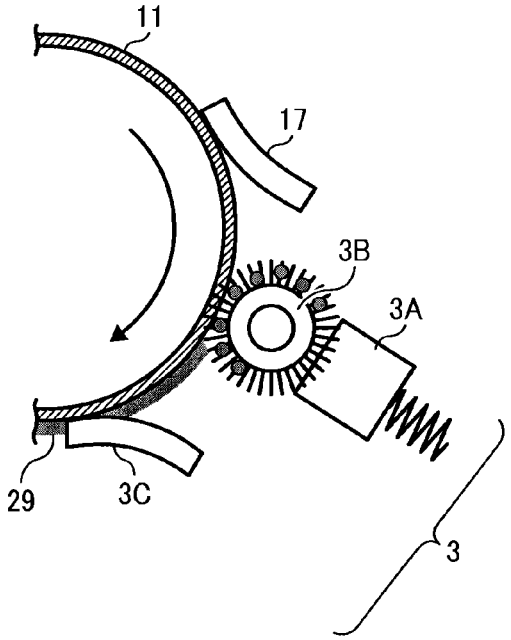
FIG. 9 is a schematic cross-sectional view illustrating a circulating agent applicator for use in the image forming apparatus.

The image forming apparatus of this disclosure includes a circulating agent applicator 3, which is illustrated in FIGS. 8 and 9 and which applies the circulating agent 3A to the photoreceptor 11. Referring to FIGS. 8 and 9, the circulating agent applicator 3 includes the fur brush 3B, the circulating agent 3A, a spring to press the circulating agent toward the fur brush, and the application blade 3C to smooth the circulating agent while regulating the circulating agent. As illustrated in FIGS. 8 and 9, the circulating agent is a molded circulating agent having a bar shape, and the tip of the fur brush 3B is contacted with the surface of the photoreceptor 11 and the bar-shaped circulating agent. Since the circulating agent scraped off with the fur brush 3B and transferred to the brush is rotated as the fur brush rotates on an axis thereof, the circulating agent is transferred onto the surface of the photoreceptor 11.

The circulating agent 3A is pressed by the spring so that the circulating agent can be contacted with the fur brush 3B even after the circulating agent is scraped off with the fur brush. Therefore, even in a case where the circulating agent 3A becomes small, the circulating agent can be scraped off with the fur brush 3B and transferred to the fur brush.

The circulating agent applicator may be a coating type applicator using a plate (like a cleaning blade) contacted with the surface of the photoreceptor in such a manner as to trail or counter the rotated photoreceptor.

Specific examples of the material of the circulating agent 3A include fatty acid metal salts such as lead oleate, zinc oleate, copper oleate, zinc stearate, cobalt stearate, iron stearate, copper stearate, zinc palmitate, copper palmitate, and zinc linoleate; and fluorine-containing resins such as polytetrafluoroethylene, polychlorotrifluoroethylene, polyvinylidene fluoride, polydichlorodifluoroethylene, tetrafluoroethylene-ethylene copolymers, and tetrafluoroethylene-oxafluoropropylene copolymers. In particular, materials having a lamella structure are preferable because of having a good circulating efficiency, and in addition zinc stearate has an advantage in terms of cost.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Image Forming Apparatus

Example 1

Preparation of Photoreceptor

The below-mentioned undercoat layer coating liquid was applied on an aluminum drum having a thickness of 1 mm, a length of 352 mm and a diameter of 40 mm, followed by drying to form an undercoat layer with a thickness of 3.5 μm. Next, the below-mentioned charge generation layer coating liquid was applied on the undercoat layer, followed by drying to form a charge generation layer with a thickness of 0.2 μm. Further, the below-mentioned charge transport layer coating liquid was applied on the charge generation layer, followed by drying to form a charge transport layer with a thickness of 22 μm.

In addition, the below-mentioned base outermost layer coating liquid was applied on the charge transport layer by spray coating under the following conditions.

Spray gun used: PC-WIDE 308 from Olympos

Atomizing pressure: 2.5 kgf/cm$^2$ (24.5 N)

Distance between nozzle of the gun and the photoreceptor: 50 mm

Amount of ejected base outermost layer coating liquid: about 3 cc

The applied base outermost layer coating liquid was dried and crosslinked to prepare a base outermost layer with a thickness of from 3 μm to 4 μm on the charge transport layer.

Undercoat Layer Coating Liquid

| | |
|---|---|
| Alkyd resin solution (BECKOLITE M6401-50 from DIC Corp.) | 12 parts |
| Melamine resin solution (SUPER BECKAMIN G-821-60 from DIC Corp.) | 8 parts |
| Titanium oxide (CR-EL from ISHIHARA SANGYO KAISHA LTD.) | 40 parts |
| Methyl ethyl ketone | 200 parts |

Charge Transport Layer Coating Liquid

| | |
|---|---|
| Z-form polycarbonate (PANLITE TS-2050manufactured by Teijin Chemicals Ltd.) | 10 parts |
| Charge transport material having the following formula | 7 parts |

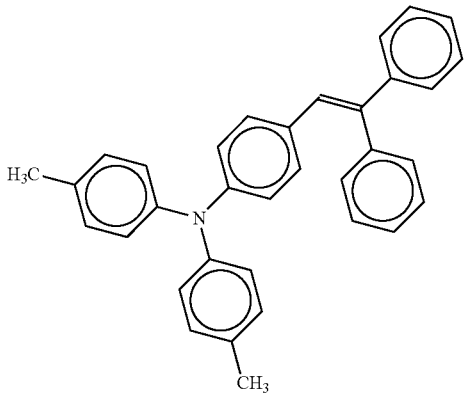

| | |
|---|---|
| Tetrahydrofuran | 100 parts |
| 1% Tetrahydrofuran solution of silicone oil (Silicone oil: KF50-100CS from Shin-Etsu Chemical Co., Ltd.) | 1 part |

Charge Generation Layer Coating Liquid

| | |
|---|---|
| Bisazo pigment having the following formula (prepared by Ricoh Co., Ltd.) | 5 parts |

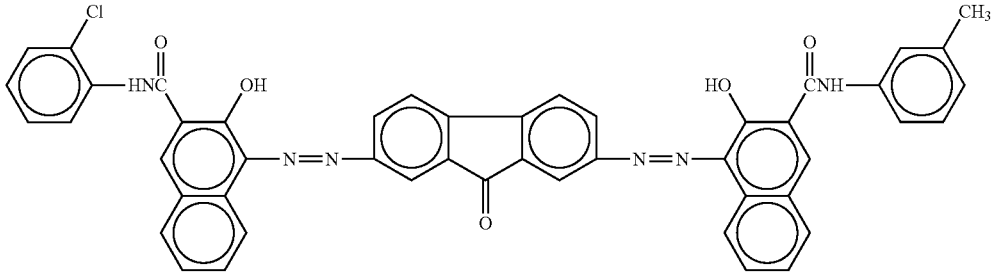

| | |
|---|---|
| Polyvinyl butyral resin (XYHL, manufactured by Union Carbide Corp.) | 1 part |
| Cyclohexanone | 200 parts |
| Methyl ethyl ketone | 80 parts |

Base Outermost Layer Coating Liquid

| | |
|---|---|
| Charge transport material having the following formula | 43 parts |
| Trimethylopropane triacrylate (KAYARAD TMPTA from Nippon Kayaku Co., Ltd.) | 21 parts |
| Caprolactone-modified dipentaerythritol hexaacrylate (KAYARAD DPCA-120 from Nippon Kayaku Co., Ltd.) | 21 parts |
| Mixture of acrylic group-containing polyester-modified polydimethyl siloxane and propoxy-modified 2-neopentyl glycol diacrylate (BYK-UV3570 from BYK Chemie AG) | 0.1 parts |
| 1-Hydroxycyclohexyl phenyl ketone (IRGACURE 184 from BASF Japan (Ciba Specialty Chemicals Corp.) | 4 parts |
| α-Alumina (SUMICORUNDUM AA-03 with average primary particle diameter of 0.3 μm from Sumitomo Chemical Co., Ltd.) | 10 parts |
| Dispersant (HIPLAAD ED-151 from Kusumoto Chemicals, Ltd.) | 0.35 parts |
| Dispersant (FLOWLEN WK-13E from Kyoeisha Chemical Co., Ltd.) | 0.65 parts |
| Tetrahydrofuran | 566 parts |

The base outermost layer coating liquid was prepared as follows. Specifically, 1.2 g of the α-alumina and 10.8 g of a mixture of the dispersants and the solvent (tetrahydrofuran) were fed into a 50-ml glass container containing 100 g of YTZ balls with a diameter of 2 mm (from Nikkato). The glass container was vibrated for 2 hours at 1,600 rpm using a vibration shaker from IKA Laboratory Technology to prepare a mill base of the α-alumina. Next, other components were added to the mill base to prepare a base outermost layer coating liquid having the above-mentioned formula.

Thus, a photoreceptor of Example 1 was prepared.

Preparation of Circulating Agent

Zinc stearate (zinc stearate GF200 from NOF Corporation) was fed into a glass container with a cap, and was agitated by a hot stirrer whose temperature was controlled in a range of from 160 to 250° C. to be melted. The melted zinc stearate was fed into an aluminum die having an internal size of 12 mm×8 mm×350 mm which was preliminarily heated to 150° C., and the die was cooled to 40° C. on a wood table. After the solidified zinc stearate was pulled from the die, the zinc stearate bar was set on the wood table to be cooled to room temperature. In this regard, a weight was set on the zinc stearate bar to prevent bending of the zinc stearate bar. After being cooled, the zinc stearate bar was cut to prepare a prismatic zinc stearate with a size of 6 mm×6 mm×322 mm. Thus, a protective agent bar (circulating agent bar) was prepared. The protective agent bar was fixed to a metal support using a double-faced adhesive tape.

Setting of Circulating Agent Applicator

A circulating agent applicator including a supplying member to supply the circulating agent and a coating member to apply the circulating agent to the surface of the photoreceptor was set to the image forming apparatus.

In the supplying member, the above-prepared circulating agent bar is pressed by a spring toward a rotating brush, wherein the spring has a certain spring constant so that a predetermined amount of the circulating agent bar is scraped off with the rotating brush, and the scraped circulating agent was supplied to the surface of the photoreceptor by the brush.

In order to control the consumption rate of the circulating agent, which is the ratio of the total weight of the circulating agent applied to the photoreceptor and the circulating agent scattered by the brush to the running distance (km), at 125 mg/km, a tension spring having a spring constant of 0.041 N/mm was used. A one-point mounting type movable fin was set on both the sides of the support supporting the circulating agent and the tension spring was connected with the fins to control the contact pressure of the circulating agent with the brush.

A genuine brush part having a structure such that a fur brush is adhered to a metal shaft was used as the brush. The brush was rotated so as to counter the rotated photoreceptor.

The application blade used for applying the circulating agent has such a structure that a polyurethane rubber blade having a Shore A hardness of 84, an impact resilience of 52%, and a thickness of 1.3 mm is set on a steel blade holder in such a manner that the blade is contacted with the photoreceptor at an angle of 19°.

The cleaning blade used for cleaning the surface of the photoreceptor while removing the circulating agent layer has such a structure that a polyurethane rubber blade having a Shore A hardness of 72, an impact resilience of 17%, and a thickness of 1.8 mm is set on a steel blade holder in such a manner that the blade is contacted with the photoreceptor at an angle of 23°.

The circulating agent applicator was set to a magenta image forming station of the image forming apparatus, IMAGIO MP C4500 from Ricoh Co., Ltd., in such a manner as illustrated in FIG. 8. Namely, the original circulating agent applicator of the image forming apparatus (IMAGIO MP C4500) was replaced with the above-prepared circulating agent applicator.

Example 2

The procedure for preparation of the photoreceptor and the image forming apparatus in Example 1 was repeated except that the two dispersants used for forming the base outermost layer coating liquid were replaced with 1 part of a dispersant AL-10 from Takemoto Oil & Fat Co., Ltd.

Example 3

The procedure for preparation of the photoreceptor and the image forming apparatus in Example 1 was repeated except that the two dispersants used for forming the base outermost layer coating liquid were replaced with 1 part of a dispersant SUPERDINE V201 from Takemoto Oil & Fat Co., Ltd.

Example 4

The procedure for preparation of the photoreceptor and the image forming apparatus in Example 1 was repeated except that the two dispersants used for forming the base outermost layer coating liquid were replaced with 0.33 parts of a dispersant SUPERDINE V201 from Takemoto Oil & Fat Co., Ltd., 0.33 parts of a dispersant FLOWLEN WK-13E from Kyoeisha Chemical Co., Ltd., and 0.33 parts of a dispersant HIPLAAD ED-151 from Kusumoto Chemicals, Ltd.

Example 5

The procedure for preparation of the photoreceptor and the image forming apparatus in Example 1 was repeated except that the two dispersants used for forming the base outermost layer coating liquid were replaced with 0.05 parts of a dispersant HIPLAAD ED-151 from Kusumoto Chemicals, Ltd.

Comparative Example 1

The procedure for preparation of the photoreceptor and the image forming apparatus in Example 1 was repeated except that the two dispersants used for forming the base outermost layer coating liquid were replaced with 1 part of a dispersant HIPLAAD ED-360 from Kusumoto Chemicals, Ltd.

Comparative Example 2

The procedure for preparation of the photoreceptor and the image forming apparatus in Example 1 was repeated except that the two dispersants used for forming the base outermost layer coating liquid were replaced with 1 part of a dispersant HIPLAAD ED-425 from Kusumoto Chemicals, Ltd.

The photoreceptors and the image forming apparatus of Examples 1 to 5 and Comparative Examples 1 and 2 were evaluated with respect to the following properties (1)-(3).

(1) Profile of Surface of Photoreceptors

The profile of surface of each photoreceptor was measured under the following conditions.

Instrument used: Surface roughness and profile measuring instrument, SURFCOM 1400D from Tokyo Seimitsu Co., Ltd.

Pickup used: E-DT-S02A

Measurement length: 12 mm

Total number of sampling points: 30,720

Measurement speed: 0.06 mm/s

The one-dimensional data array of the profile of the surface of the photoreceptor was subjected to a first multi-resolution analysis (MRA-1) using wavelet transformation to be separated into six frequency components of from HHH to HLL. Further, the one-dimensional data array of the HLL was thinned so that the number of the data array was reduced to 1/40, and the thinned one-dimensional data array was subjected to a second multi-resolution analysis (MRA-2) using wavelet transformation to be separated into six frequency components of from LHH to LLL. The Arithmetical Mean Deviation of the Profile (WRa) of each of the thus obtained twelve frequency components of from HHH to LLL was obtained.

This surface profile measurement was performed on four portions of the surface of the photoreceptor, which portions are apart at regular intervals of 70 mm. The Arithmetical Mean Deviation of the Profile (WRa) of each of the twelve frequency components of from HHH to LLL in each portion was obtained.

In this regard, WAVELET TOOLBOX of MATLAB from The MathWorks was used for the wavelet transformation. As mentioned above, the wavelet transformation was performed twice.

The average of the four data of the Arithmetical Mean Deviation of the Profile (WRa) of each of the twelve frequency components was obtained to determine the Arithmetical Mean Deviation of the Profile (WRa) of the frequency component.

The results are shown in Table 2 below, and the surface roughness spectra are shown in FIGS. 18-24.

(2) Circularity of Surface of Photoreceptor

Each of the photoreceptors was subjected to a first print test in which an entire solid image is repeatedly formed while rotating the photoreceptor 2,500 turns (i.e., 951 prints are produced), and a second print test in which an entire solid image is repeatedly formed while rotating the photoreceptor 25,000 turns (i.e., 9500 prints are produced).

After each print test, air blowing using air of 4 MPa was performed on the surface of the photoreceptor, and three surface portions (including at least the applied circulating agent, the base outermost layer and the charge transport layer) of the photoreceptor, which portions have a size of 34 mm×34 mm and are apart from each other at regular intervals in the longitudinal direction of the photoreceptor and which portions are present on a slightly downstream side from the circulating agent applicator when the photoreceptor is stopped at the end of the print test, were obtained.

The thickness of the thus obtained films of the surface portions of the photoreceptor was measured by an XRF analysis. The difference between the thickness of the circulating agent layer (circulating outermost layer) after the first print test (2,500 turns) and the second print test (25,000 tunes) was calculated from the below-mentioned equation (1) to evaluate variation of the thickness of the circulating outermost layer. In this regard, if the thickness of the circulating outermost layer after the second print test is greater than that after the first print test (i.e., if the thickness increases), it is regarded that the circulating agent is not satisfactorily removed from the surface of the photoreceptor. It is ideal that the thickness of the circulating outermost layer hardly changes. It is the next best that the thickness of the circulating outermost layer slightly decreases. However, it is not preferable that the thickness considerably decreases because the surface of the photoreceptor has poor stability.

$$\tau = f\alpha + \beta \quad (1),$$

wherein $\tau$ represents the mass thickness of the circulating agent in units of nanometer, f represents a proportionality coefficient, a represents the number of application of the circulating agent (when the photoreceptor is a drum, the number of revolutions of the drum in units of thousand turns), and $\beta$ represents a constant.

The coefficients f and $\beta$ are calculated as follows. Specifically, in a graph in which the thickness is plotted on the vertical axis and the revolution (in units of thousand turns, i.e., 2.5 thousand turns and 25 thousand turns) of the photoreceptor is plotted on the horizontal axis, the data of the thickness of the photoreceptor after the first and second print tests are plotted to obtain a linear approximation line. The slope of the line is f, and the intercept of the line is $\beta$. The linear approximation line can be obtained by using spreadsheet software. For example, by using a scatter diagram prepared using Microsoft Excel and an additional command of linear approximation line, the coefficients f and $\beta$ can be determined.

In the XRF analysis, initially a working curve was prepared using data of the mount of zinc obtained by an ICP-AES analysis and data obtained by the XRF analysis, and the thickness of the circulating outermost layer was determined by comparing the strength of the XRF with the data of the ICP-AES using the working curve. When the circulating outermost layer has many defects, the apparent thickness decreases, and therefore it is difficult to determine the thickness of the film portion of the circulating outermost layer. Therefore, the mass thickness determined by the XRF analysis was divided by the coverage determined by the XPS analysis to determine the average thickness of the film portion of the circulating outermost layer.

In the ICP-AES analysis, a sample liquid obtained by decomposing the sample using a sulfuric acid and nitric acid is used. The XRF analysis was performed by an instrument ZSX-100e from Rigaku Corporation, and the above-mentioned film obtained from the photoreceptor and having a size of 34 mm×34 mm was used as the sample.

The results are shown in Table 3 below.

(3) Measurement of Acting Forces of Blade

By using the instrument illustrated in FIG. 25, the acting forces of the application blade and the cleaning blade were measured. The application blade and the cleaning blade were set in the photoreceptor cartridge of IMAGIO MP C4500, and the cartridge was set in the image forming apparatus IMAGIO MP C4500, wherein the angle and digging amount of the blades, and the rotation speed of the photoreceptor were the same as those in the process cartridge exclusive to the image forming apparatus. The acting forces (tangential force Ft and normal force Fn) of the blades set in the process cartridge were measured under an environmental condition of 26° C. and 50% RH after the photoreceptor was rotated 2,500 turns while applying the circulating agent on the surface of the photoreceptor.

TABLE 2

| | HHH | HHL | HMH | HML | HLH | LHH | LHL | LMH | LML | LLH | LLL |
|---|---|---|---|---|---|---|---|---|---|---|---|
| Ex. 1 | 0.004 | 0.003 | 0.002 | 0.002 | 0.003 | 0.005 | 0.004 | 0.006 | 0.024 | 0.037 | 0.091 |
| Ex. 2 | 0.004 | 0.003 | 0.002 | 0.004 | 0.006 | 0.009 | 0.005 | 0.004 | 0.004 | 0.027 | 0.104 |
| Ex. 3 | 0.004 | 0.002 | 0.002 | 0.005 | 0.007 | 0.006 | 0.006 | 0.011 | 0.021 | 0.031 | 0.090 |
| Ex. 4 | 0.004 | 0.002 | 0.002 | 0.002 | 0.002 | 0.003 | 0.002 | 0.004 | 0.014 | 0.031 | 0.060 |
| Ex. 5 | 0.004 | 0.003 | 0.003 | 0.006 | 0.012 | 0.018 | 0.011 | 0.009 | 0.013 | 0.039 | 0.099 |
| Comp. Ex. 1 | 0.004 | 0.003 | 0.002 | 0.003 | 0.005 | 0.009 | 0.006 | 0.004 | 0.007 | 0.024 | 0.097 |
| Comp. Ex. 2 | 0.004 | 0.003 | 0.002 | 0.003 | 0.005 | 0.007 | 0.009 | 0.019 | 0.026 | 0.030 | 0.078 |

In Table 2, the unit is μm.

TABLE 3

| | Application blade | | Cleaning blade | | Thickness τ (nm) after | Thickness τ (nm) after | Coefficient |
|---|---|---|---|---|---|---|---|
| | Ft/Fn | Ft (kgf) | Ft/Fn | Ft (kgf) | 2,500 turns | 25,000 turns | f |
| Ex. 1 | 0.93 | 1.27 | 0.93 | 1.29 | 11.30 | 11.30 | 0.00 |
| Ex. 2 | 0.96 | 1.24 | 0.95 | 1.26 | 12.30 | 10.50 | −0.08 |
| Ex. 3 | 0.90 | 1.23 | 0.91 | 1.25 | 12.20 | 9.90 | −0.10 |
| Ex. 4 | 0.93 | 1.35 | 0.93 | 1.35 | 11.50 | 10.10 | −0.06 |
| Ex. 5 | 0.93 | 1.15 | 0.93 | 1.17 | 11.70 | 9.70 | −0.09 |
| Comp. Ex. 1 | 1.10 | 1.25 | 1.12 | 1.27 | 12.30 | 18.30 | 0.27 |
| Comp. Ex. 2 | 0.87 | 1.25 | 0.84 | 1.27 | 12.20 | 5.40 | −0.30 |

It is clear from Table 3 that since the application blade and the cleaning blade of each of the image forming apparatuses of Examples 1-5 and Comparative Examples 1 and 2 satisfy the condition of from 1.15 kgf to 1.35 kgf in tangential force, the image forming apparatuses can stably form a circulating outermost layer. Among these image forming apparatuses, the image forming apparatus of Example 1 has an advantage such that the surface of the photoreceptor hardly changes even after the second print test (25,000 turns). Namely, a high quality circulating outermost layer can be formed on the photoreceptor of the image forming apparatus of Example 1. The thickness of the circulating outermost layer after the photoreceptor is rotated 2,500 turns is the same as that after the photoreceptor is rotated 25,000 turns. This means that input and output of the circulating agent on the surface of the photoreceptor of Example 1 are equivalent.

The change rate (i.e., coefficient f) of the thickness of the circulating outermost layer of the photoreceptors of Examples 2 to 5 is small. Among the photoreceptors of Examples 1-5, the photoreceptors of Examples 1 and 4 are advantageous because of having a relatively small change rate. In the photoreceptors of Examples 1 and 4, the WRa (LLH) is less than 0.04 μm, and the WRa(HLH) is less than 0.005 μm. The ratio Ft/Fn of the blades for these photoreceptors is different from those for the other photoreceptors. Therefore, it is considered that by forming a surface having a specific surface profile on a photoreceptor, formation of a circulating outermost layer on the surface of the photoreceptor can be stably performed.

In contrast, the image forming apparatuses of Comparative Examples 1 and 2 cannot satisfy the relationship, $0.90 \leq Ft/Fn \leq 0.96$. Namely, the thickness of the circulating outermost layer seriously varies with time. Since input and output of the circulating agent on the surface of the photoreceptors of Comparative Examples 1 and 2 are not equivalent, the surface of the photoreceptors deteriorates with time.

As mentioned above, in the image forming apparatus, the life of the photoreceptor can be prolonged, and therefore the image forming apparatus can produce prints at low costs.

Additional modifications and variations of the present invention are possible in light of the above teachings. It is therefore to be understood that within the scope of the appended claims the invention may be practiced other than as specifically described herein.

What is claimed is:

1. An image forming apparatus comprising:

a photoreceptor;

a charger to charge a surface of the photoreceptor;

a circulating agent applicator to apply a circulating agent to the surface of the photoreceptor while contacting the surface of the photoreceptor to form a film of the circulating agent on the surface of the photoreceptor; and a contact member contacted with the surface of the photoreceptor, wherein an acting force, which is generated by contact of the contact member with the photoreceptor and includes a tangential force Ft, which is a force in a tangential direction at a contact portion of the contact member with the surface of the photoreceptor, and a normal force Fn, which is a force in a normal direction at the contact portion, satisfies the following relationships:

$0.90 \leq Ft/Fn \leq 0.96$, and $1.15\ \text{kgf} \leq Ft \leq 1.35\ \text{kgf}$.

2. The image forming apparatus according to claim 1, wherein the film of the circulating agent is a circulating outermost layer.

3. The image forming apparatus according to claim 2, wherein the photoreceptor includes:

an electroconductive support;

a photosensitive layer overlying the electroconductive support;

a base outermost layer overlying the photosensitive layer; and the circulating outermost layer on the base outermost layer, wherein the base outermost layer has a surface profile such that when Arithmetical Mean Deviation of the Profile WRa of each of twelve frequency components is determined by the below-mentioned method, and logarithmic values of the Arithmetical Mean Deviation of the Profile WRa of eleven frequency components LLL, LLH, LML, LMH, LHL, LHH, HLH, HML, HMH, HHL and HHH of the twelve frequency components except for a frequency component HLL are plotted in a graph from left to right to form a curve, the curve has no folding point in a range of from the frequency component LLL to the frequency component LHL while having a folding point in a range of from the frequency component LHL to the frequency component HMH, and the Arithmetical Mean Deviation of the Profile WRa(LLH) of the frequency component LLH is less than 0.04 μm, and the Arithmetical Mean Deviation of the Profile WRa(HLH) of the frequency component HLH is less than 0.005 μm, wherein the method includes the following processes (I) to (V):

(I) measuring a profile of the surface of photoreceptor using a surface roughness and profile measuring instrument to prepare a one-dimensional data array;

(II) subjecting the one-dimensional data array to wavelet transformation by a multi-resolution analysis to separate the data array into six frequency components of from a high frequency component to a low frequent component including the frequency components HHH, HHL, HMH, HML, HLH and HLL;

(III) thinning the one-dimensional data array of the minimum frequency component FILL so that a number of data array is reduced to 1/10 to 1/100 to prepare a thinned one-dimensional data array;

(IV) subjecting the thinned one-dimensional data array to wavelet transformation by a multi-resolution analysis to separate the data array into six frequency components of from a high frequency component to a low frequent component including the frequency components LHH, LHL, LMH, LML, LLH and LLL; and (V) obtaining the Arithmetical Mean Deviation of the Profile WRa of each of the thus obtained twelve frequency components, wherein the Arithmetical Mean Deviation of the Profile WRa of the twelve frequency components is the following:

(1) WRa(HHH) which is Arithmetical Mean Deviation of the Profile Ra of a band in which a length of one convex-concave cycle is 0.3 μm to 3 μm;

(2) WRa(HHL) which is the Arithmetical Mean Deviation of the Profile Ra of a band in which the length of one convex-concave cycle is 1 μm to 6 μm;

(3) WRa(HMH) which is the Arithmetical Mean Deviation of the Profile Ra of a band in which the length of one convex-concave cycle is 2 μm to 13 μm;

(4) WRa(HML) which is the Arithmetical Mean Deviation of the Profile Ra of a band in which the length of one convex-concave cycle is 4 μm to 25 μm;

(5) WRa(HLH) which is the Arithmetical Mean Deviation of the Profile Ra of a band in which the length of one convex-concave cycle is 10 μm to 50 μm;

(6) WRa(HLL) which is the Arithmetical Mean Deviation of the Profile Ra of a band in which the length of one convex-concave cycle is 24 μm to 99 μm;

(7) WRa(LHH) which is the Arithmetical Mean Deviation of the Profile Ra of a band in which the length of one convex-concave cycle is 26 μm to 106 μm;

(8) WRa(LHL) which is the Arithmetical Mean Deviation of the Profile Ra of a band in which the length of one convex-concave cycle is 53 μm to 183 μm;

(9) WRa(LMH) which is the Arithmetical Mean Deviation of the Profile Ra of a band in which the length of one convex-concave cycle is 106 μm to 318 μm;

(10) WRa(LML) which is the Arithmetical Mean Deviation of the Profile Ra of a band in which the length of one convex-concave cycle is 214 μm to 551 μm;

(11) WRa(LLH) which is the Arithmetical Mean Deviation of the Profile Ra of a band in which the length of one convex-concave cycle is 431 μm to 954 μm; and

(12) WRa(LLL) which is the Arithmetical Mean Deviation of the Profile Ra of a band in which the length of one convex-concave cycle is 867 μm to 1654 μm.

4. The image forming apparatus according to claim 3, wherein the base outermost layer includes a three-dimensionally crosslinked resin.

5. The image forming apparatus according to claim 3, wherein the base outermost layer includes a particulate filler, which is dispersed in the base outermost layer.

6. The image forming apparatus according to claim 5, wherein the particulate filler includes a particulate metal oxide.

7. The image forming apparatus according to claim 6, wherein the particulate metal oxide includes a particulate aluminum oxide.

8. The image forming apparatus according to claim 7, wherein the particulate aluminum oxide is α-alumina having a volume average primary particle diameter of from 0.2 μm to 0.5 μm.

9. The image forming apparatus according to claim 1, wherein the contact member is a cleaning blade to clean the surface of the photoreceptor.

10. The image forming apparatus according to claim 1, wherein the contact member is an application blade to smooth the circulating agent applied on the surface of the photoreceptor by the circulating agent applicator.

11. An image forming method comprising:

forming a toner image on a surface of a moving photoreceptor;

applying a circulating agent to the surface of the moving photoreceptor; and contacting a contact member with the surface of the moving photoreceptor, wherein an acting force, which is generated by contact of the contact member with the photoreceptor and includes a tangential force Ft, which is a force in a tangential direction at a contact portion of the contact member with the surface of the photoreceptor, and a normal force Fn, which is a force in a normal direction at the contact portion, satisfies the following relationships:

$0.90 \leq Ft/Fn \leq 0.96$, and $1.15\ \text{kgf} \leq Ft \leq 1.35\ \text{kgf}$.

* * * * *